US012601038B2

(12) United States Patent
Zaizen et al.

(10) Patent No.: US 12,601,038 B2
(45) Date of Patent: Apr. 14, 2026

(54) NON-ORIENTED ELECTRICAL STEEL SHEET, MOTOR CORE, AND PRODUCTION METHODS THEREOF

(71) Applicant: JFE STEEL CORPORATION, Tokyo (JP)

(72) Inventors: Yoshiaki Zaizen, Tokyo (JP); Nobuko Nakagawa, Tokyo (JP); Yoshihiko Oda, Tokyo (JP); Tomoyuki Okubo, Tokyo (JP); Chiyoko Tada, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 1029 days.

(21) Appl. No.: 17/770,709

(22) PCT Filed: Oct. 12, 2020

(86) PCT No.: PCT/JP2020/038448

§ 371 (c)(1),
(2) Date: Apr. 21, 2022

(87) PCT Pub. No.: WO2021/117325

PCT Pub. Date: Jun. 17, 2021

(65) Prior Publication Data

US 2022/0372600 A1 Nov. 24, 2022

(30) Foreign Application Priority Data

Dec. 9, 2019 (JP) ..... 2019-222090

(51) Int. Cl.
*C22C 38/14* (2006.01)
*C21D 8/02* (2006.01)
(Continued)

(52) U.S. Cl.
CPC ..... *C22C 38/14* (2013.01); *C21D 8/0205* (2013.01); *C21D 8/0226* (2013.01);
(Continued)

(58) Field of Classification Search
None
See application file for complete search history.

(56) References Cited

U.S. PATENT DOCUMENTS

2012/0301744 A1 11/2012 Sashi et al.
2014/0345751 A1* 11/2014 Oda ..... C22C 38/24 148/309
(Continued)

FOREIGN PATENT DOCUMENTS

CN 105189800 A 12/2015
CN 106536778 A 3/2017
(Continued)

OTHER PUBLICATIONS

Dec. 5, 2022 Office Action issued in Chinese Patent Application No. 20280076088.9.
(Continued)

*Primary Examiner* — Anthony M Liang
(74) *Attorney, Agent, or Firm* — Oliff PLC

(57) ABSTRACT

In a production of a non-oriented electrical steel sheet by hot-rolling a steel slab containing Si: 2.8 to 6.5 mass % and Zn: 0.0005 to 0.0050 mass % followed by cold rolling and finish annealing, a coating agent containing at least one element selected from Sn, Sb, P, S, Se, As, Te, B, Pb, and Bi is applied to the steel sheet surface after the finish annealing to form an insulation coating with a nitriding-suppressing ability. Alternatively, an intermediate layer containing at least one element selected from Sn, Sb, P, S, Se, As, Te, B, Pb, and Bi and having a nitriding-suppressing ability is formed on the steel sheet iron matrix after the finish annealing and form an insulation coating not containing above elements is formed on the intermediate layer thus to obtain a non-oriented electrical steel sheet from which a rotor core with high strength and stator core with excellent magnetic properties after the stress-relief annealing can be obtained at
(Continued)

the same time, and a motor core comprising a stator core and rotor core is produced from the steel sheet.

5 Claims, 3 Drawing Sheets

(51) Int. Cl.

| | |
|---|---|
| ***C21D 8/0221*** | (2026.01) |
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/12*** | (2006.01) |

(52) U.S. Cl.
CPC ..... *C21D 8/0236* (2013.01); *C21D 9/46* (2013.01); *C22C 38/002* (2013.01); *C22C 38/02* (2013.01); *C22C 38/04* (2013.01); *C22C 38/06* (2013.01); *C22C 38/12* (2013.01)

(56) References Cited

U.S. PATENT DOCUMENTS

| | | | |
|---|---|---|---|
| 2016/0020007 | A1 | 1/2016 | Oda et al. |
| 2017/0162295 | A1 | 6/2017 | Sashi et al. |
| 2017/0229222 | A1 | 8/2017 | Nakanishi et al. |
| 2019/0228891 | A1 | 7/2019 | Natori et al. |
| 2019/0330708 | A1 | 10/2019 | Okubo et al. |
| 2019/0345576 | A1 | 11/2019 | Park et al. |
| 2019/0367746 | A1 | 12/2019 | Takeda et al. |
| 2019/0382867 | A1 | 12/2019 | Zaizen et al. |
| 2020/0010918 | A1 | 1/2020 | Zaizen et al. |
| 2020/0040423 | A1 | 2/2020 | Natori et al. |
| 2020/0095659 | A1 | 3/2020 | Kim et al. |
| 2021/0027922 | A1 | 1/2021 | Yasuda et al. |

FOREIGN PATENT DOCUMENTS

| | | | | |
|---|---|---|---|---|
| CN | 110088328 | A | 8/2019 | |
| CN | 110114488 | A | 8/2019 | |
| CN | 110114489 | A | 8/2019 | |
| CN | 110249063 | A | 9/2019 | |
| CN | 110536971 | A | 12/2019 | |
| EP | 3 556 882 | A1 | 10/2019 | |
| EP | 3 561 102 | A1 | 10/2019 | |
| JP | H11-181577 | A | 7/1999 | |
| JP | 2001-223105 | A | 8/2001 | |
| JP | 2008-050686 | A | 3/2008 | |
| JP | 4779474 | B2 | 9/2011 | |
| JP | 2014-208885 | A | 11/2014 | |
| JP | 5780379 | B1 | 9/2015 | |
| JP | 2015-206092 | A | 11/2015 | |
| JP | 2018-021241 | A | 2/2018 | |
| JP | 2018-021242 | A | 2/2018 | |
| KR | 100479992 | B1 * | 3/2005 | ..... C21D 8/1222 |
| TW | 201839169 | A | 11/2018 | |
| WO | 2011/055857 | A1 | 5/2011 | |
| WO | 2018/025941 | A1 | 2/2018 | |
| WO | 2018/147044 | A1 | 8/2018 | |
| WO | 2019/017426 | A1 | 1/2019 | |
| WO | 2019/146694 | A1 | 8/2019 | |

OTHER PUBLICATIONS

May 10, 2023 Extended European Search Report Issued in European Patent Application No. 20899309.7.
Jul. 7, 2021 Office Action issued in Taiwanese Patnet Application No. 109142711.
Mar. 15, 2022 Office Action issued in Japanese Patent Application No. 2021-507862.
Dec. 15, 2020 Search Report issued in International Patent Application No. PCT/JP2020/038448.

* cited by examiner

NON-ORIENTED ELECTRICAL STEEL SHEET, MOTOR CORE, AND PRODUCTION METHODS THEREOF

TECHNICAL FIELD

This invention relates to a non-oriented electrical steel sheet and a motor core, which are preferably used for an iron core of a small-sized and high-output motor, as well as methods for producing the non-oriented electrical steel sheet and the motor core.

BACKGROUND ART

With the growing demand for energy saving in electric equipment in recent years, non-oriented electrical steel sheets used in an iron core of a rotary appliance (motor core) have been required to have more excellent magnetic properties than conventional ones. In particular, a driving motor for a hybrid car (HEV) needs to be smaller in size and higher in output power, and hence a non-oriented electrical steel sheet used as a material of such motor cores has been demanded to have more excellent magnetic properties (higher magnetic flux density and lower iron loss).

A motor core comprises a fixed stator core and a rotating rotor core. The revolution number of an HEV-driven motor tends to be increased to achieve a smaller size and higher output power, so that a big centrifugal force is applied to the rotor core of the HEV-driven motor having a large outer diameter. Also, a rotor core has a very narrow portion (1 to 2 mm) called a bridge portion, depending on its structure. Therefore, a non-oriented electrical steel sheet used in a rotor core of an HEV-driven motor is strongly required to have a higher strength than the conventional ones.

The non-oriented electrical steel sheet used in a motor core of an HEV-driven motor is desired to have excellent magnetic properties. Moreover, it is desired to have high strength for use in the rotor core while having higher magnetic flux density and lower iron loss for use in the stator core. Thus, a rotor core and a stator core are required to have significantly different characteristics even in the same motor core. Meanwhile, it is desirable to take out rotor core material and stator core material from the same raw material steel sheet at the same time in order to increase the material yield and reduce the stock of material from the viewpoint of production of a motor core.

As the non-oriented electrical steel sheet having high strength and excellent magnetic properties as described above, for example, Patent Literature 1 proposes a method for producing a motor core comprising taking out, by blanking, rotor core material and stator core material from a non-oriented electrical steel sheet having a sheet thickness of 0.15 to 0.35 mm and a yield strength before stress-relief annealing of not less than 600 MPa at the same time, laminating respective materials to assemble a rotor core and a stator core, and thereafter subjecting only the stator core to stress-relief annealing, so that the motor core has an iron loss $W_{10/400}$ of not more than 20 W/kg after the stress-relief annealing.

CITATION LIST

Patent Literature

Patent Literature 1: JP-A-2008-50686

SUMMARY OF INVENTION

Technical Problem

In the technique disclosed in Patent Literature 1, however, an expensive element Ni is added by not less than 0.5 mass % to increase the strength of the steel sheet, causing a problem of high production costs. Also, when the steel sheet disclosed in Patent Literature 1 is subjected to stress-relief annealing, the magnetic properties, especially iron loss properties are deteriorated, causing a big problem of decreasing motor efficiency.

The invention is made in consideration of the above problems and aims to provide a non-oriented electrical steel sheet from which a rotor core with high strength and a stator core with excellent magnetic properties after stress-relief annealing can be taken out at the same time without using expensive Ni and a motor core made from the non-oriented electrical steel sheet, and also to propose methods for producing the non-oriented electrical steel sheet and the motor.

Solution to Problem

To solve the above problems, especially to prevent the deterioration of magnetic properties after stress-relief annealing, the inventors have made various studies focusing on the influence of the surface nature upon magnetic properties of a non-oriented electrical steel sheet. As a result, the inventors have found that the deterioration of the magnetic properties caused by stress-relief annealing results from the nitriding in the steel sheet surface layer at the stress-relief annealing, and that, in order to suppress the nitriding in the steel sheet surface layer, it is effective that a steel material (slab) contains a prescribed amount of Zn and that a coating having a proper ability to suppress nitriding on the steel sheet surface before the stress-relief annealing, resulting in the development of the invention.

That is, the present invention is a non-oriented electrical steel sheet having a component composition comprising: C: not more than 0.0050 mass %, Si: 2.8 to 6.5 mass %, Mn: 0.1 to 2.0 mass %, P: not more than 0.10 mass %, S: not more than 0.0050 mass %, Al: 0.3 to 2.0 mass %, N: not more than 0.0050 mass %, Zn: 0.0005 to 0.0050 mass %, Ti: not more than 0.0030 mass %, Nb: not more than 0.0030 mass %, O: not more than 0.0050 mass %, and the remainder being Fe and inevitable impurities, and having a coating layer containing at least one element selected from Sn, Sb, P, S, Se, As, Te, B, Pb, and Bi on the steel sheet surface.

The non-oriented electrical steel sheet according to the present invention is characterized by containing, in addition to the above-described component composition, at least one composition group selected from following Groups A to D:

- Group A: one or two selected from Sn: 0.005 to 0.20 mass % and Sb: 0.005 to 0.20 mass %;
- Group B: one or two or more selected from Ca, Mg and REM by 0.0005 to 0.020 mass % in total;
- Group C: one or two or more selected from Cu, Ni, Cr, and Co by 0.01 to 1.0 mass % in total; and
- Group D: one or two selected from Mo: 0.001 to 0.1 mass % and W: 0.001 to 0.1 mass %.

The coating layer of the non-oriented electrical steel sheet according to the invention is an insulation coating formed on the surface of the iron matrix of the steel sheet.

The coating layer of the non-oriented electrical steel sheet according to the invention includes an insulation coating formed on an uppermost layer on the steel sheet surface and an intermediate layer formed between the insulation layer and the iron matrix surface of the steel sheet. The intermediate layer contains at least one element selected from Sn, Sb, P, S, Se, As, Te, B, Pb, and Bi.

The invention proposes a method for producing a non-oriented electrical steel sheet comprising subjecting a steel slab to hot rolling, cold rolling, and finish annealing, in which the steel slab has a component composition comprising C: not more than 0.0050 mass %, Si: 2.8 to 6.5 mass %, Mn: 0.1 to 2.0 mass %, P: not more than 0.10 mass %, S: not more than 0.0050 mass %, Al: 0.3 to 2.0 mass %, N: not more than 0.0050 mass %, Zn: 0.0005 to 0.0050 mass %, Ti: not more than 0.0030 mass %, Nb: not more than 0.0030 mass %, O: not more than 0.0050 mass %, and the remainder being Fe and inevitable impurities, and a coating layer containing at least one element selected from Sn, Sb, P, S, Se, As, Te, B, Pb, and Bi is formed on the steel sheet surface after the finish annealing.

The steel slab used in the method for producing a non-oriented electrical steel sheet is characterized by containing at least one composition group selected from following Groups A to D:

Group A: one or two selected from Sn: 0.005 to 0.20 mass % and Sb: 0.005 to 0.20 mass %;

Group B: one or two or more selected from Ca, Mg and REM by 0.0005 to 0.020 mass % in total;

Group C: one or two or more selected from Cr, Co, Ni, and Cu by 0.01 to 1.0 mass % in total; and Group D: one or two selected from Mo: 0.001 to 0.1 mass % and W: 0.001 to 0.1 mass %.

The method for producing a non-oriented electrical steel sheet is characterized by applying a coating agent containing at least one element selected from Sn, Sb, P, S, Se, As, Te, B, Pb, and Bi to the iron matrix surface of the steel sheet after finish annealing thus to form, as the coating layer, an insulation coating with a nitriding-suppressing ability.

The method for producing a non-oriented electrical steel sheet is characterized by applying a treatment agent containing at least one element selected from Sn, Sb, P, S, Se, As, Te, B, Pb, and Bi to the iron matrix surface of the steel sheet after the finish annealing to form, as the coating layer, an intermediate layer with a nitriding-suppressing ability and forming an insulation coating not containing the above-described elements on the intermediate layer.

The invention is a motor core comprising a rotor core formed by laminating core material that is processed from any one of the above non-oriented electrical steel sheets into a core shape and a stator core formed by laminating core material that is processed from the same non-oriented electrical steel sheet as above into a core shape and performing stress-relief annealing thereto, in which the steel sheet configuring the stator core has an iron loss $W_{10/800}$ (W/kg) satisfying the following equation (1) with respect to the sheet thickness t (mm):

$$W_{10/800} \leq 15+80\times t \quad (1) \text{ and}$$

N present as AlN (N as AlN) in a layer from a one-side surface to 1/20 of the sheet thickness of the steel sheet after the stress-relief annealing is not more than 0.0100 mass %.

The present invention proposes a method for producing a motor core composed of a stator core and rotor core comprising processing a non-oriented electrical steel sheet produced by any one of the methods described above into a core shape, laminating the core-shaped material to assemble a stator core and rotor core, subjecting the stator core to stress-relief annealing, in which the stress-relief annealing is performed under an atmosphere comprising one gas selected from nitrogen, hydrogen, and rare gas or a mixture of two or more of the gases at a soaking temperature of 800 to 950° C. for a soaking time of 0.5 to 3.0 hr.

The method for producing a motor core according to the invention is characterized in that the steel sheet after the stress-relief annealing has an iron loss $W_{10/800}$ (W/kg) satisfying the following equation (1) with respect to the sheet thickness t (mm):

$$W_{10/800} \leq 15+80\times t \quad (1) \text{ and}$$

N present as AlN (N as AlN) in a layer from a one-side surface to 1/20 of the sheet thickness of the steel sheet after the stress-relief annealing is not more than 0.0100 mass %.

Advantageous Effects of Invention

The present invention is capable of producing a rotor core required to have high strength and a stator core required to have a low iron loss after stress-relief annealing from the same steel sheet material. Therefore, the non-oriented electrical steel sheet according to the present invention can largely contribute to downsizing and higher output efficiency of motors used in HEVs, electric cars, vacuum cleaners, high-speed generators, air compressors, machine tools, and so on.

DESCRIPTION OF EMBODIMENTS

An embodiment of the present invention will be described in detail below.

First Embodiment

The first embodiment of the present invention is characterized in that a steel material (slab) contains an adequate amount of Zn to thereby form a coating comprised of a composite compound such as an oxide containing Zn or Al on the steel sheet surface after finish annealing, and an insulation coating containing at least one element selected from Sn, Sb, P, S, Se, As, Te, B, Pb, and Bi is formed on the steel sheet surface after the finish annealing to thereby apply a nitriding-suppressing ability to both coatings, suppressing nitriding of the steel sheet surface at stress-relief annealing.

First, an experiment that has led to the development of the first embodiment of the invention will be explained below.

Experiment 1

Two charges (Charges A and B) of steel having a component composition comprising C: 0.0025 mass %, Si: 3.5 mass %, Mn: 0.6 mass %, P: 0.01 mass %, S: 0.0015 mass %, Al: 0.9 mass %, N: 0.0023 mass %, Ti: 0.0011 mass %, Nb: 0.0009 mass %, O: 0.0021 mass % and the remainder being Fe and inevitable impurities are melt to form steel material (slab) by continuous casting method. The slab is hot-rolled to form a hot-rolled sheet with a sheet thickness of 1.9 mm, subjected to hot-band annealing at 950° C. for 30 seconds, pickled, and cold-rolled to form a cold-rolled sheet with a final sheet thickness of 0.30 mm. The cold-rolled sheet is subjected to finish annealing at 800° C. for 10 seconds under an atmosphere of $H_2$:$N_2$=20:80 by vol % ratio, and an insulation coating is formed on the front and rear sides of the steel sheet after the finish annealing to form a product sheet. Note that the insulation coating is coated by mixing monomagnesium phosphate: Mg $(H_2PO_4)_2$ (made by Taihei Chemical Industrial Co., Ltd.) and acrylic resin (EFD-5560 made by DIC Corporation) to have a solid content ratio of 90:10 by mass % ratio, adjusting the solid content concentration of the mixture to 10 mass % using deionized water to form an application liquid, applying the application liquid on both sides of the steel sheet by a roll coater such that the coating of each side has a coating weight of 0.5 g/$m^2$ after the baking, and baking the steel sheet in a hot-air furnace under a condition that the highest sheet temperature of 280° C. is reached in 30 seconds (a soaking temperature is 0 second).

Figure 1A:
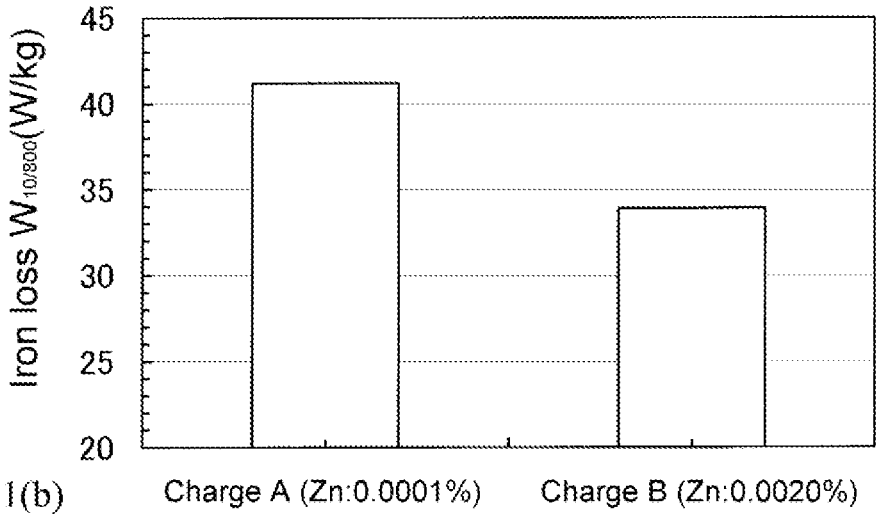
FIG. 1 is a graph showing variations of an iron loss $W_{10/800}$ after stress-relief annealing and an N concentration in a layer of 1/20 of the sheet thickness of the steel sheet in different tapping charges.
Figure 1B:
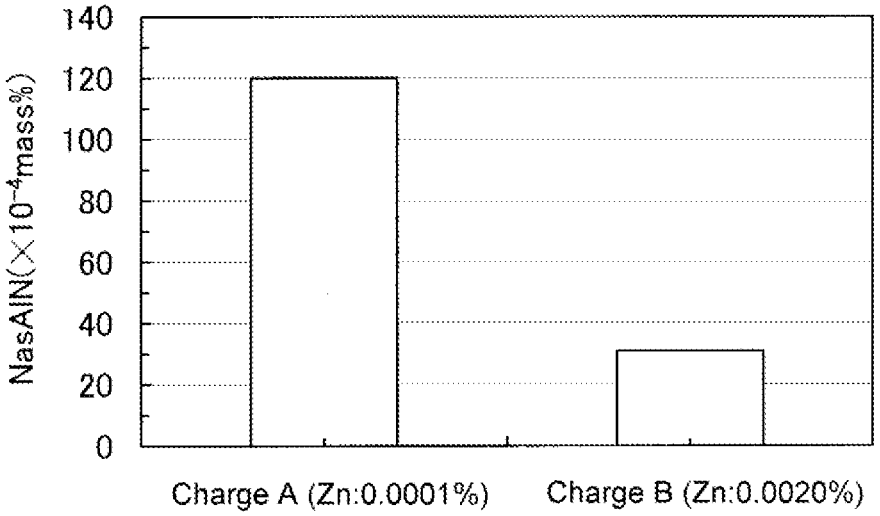

Next, test specimens with a length of 280 mm and a width of 30 mm are cut out from the rolling direction (L direction) and the direction (C direction) perpendicular to the rolling direction of a product sheet coated with the insulation coating and subjected to a heat treatment simulating stress-relief annealing at 850° C. for 1 hour in an atmosphere of $N_2$=100 vol %, and thereafter the high-frequency iron loss $W_{10/800}$ in (L+C) direction is measured by the Epstein test. The result shows that there are variations in the measurement values of the iron loss, and as shown in FIG. 1(*a*), the iron loss after stress-relief annealing for a specific charge (Charge B) is excellent. In order to examine the cause thereof, the N concentration (N as AlN) present as AlN in the surface layer of the steel sheet, specifically within the layer from the one side surface to 1/20 of the thickness of the steel sheet (hereinafter "the layer from the one side surface to 1/20 of the thickness of the steel sheet" is simply referred to "1/20 sheet thickness layer") is examined. The result shows that, as shown in FIG. 1(*b*), nitriding is caused in the surface layer in the steel sheet of Charge A with a high iron loss while the N concentration in the surface layer of the steel sheet of Charge B with a low iron loss has little difference from the value at the tapping and nitriding is suppressed. Accordingly, trace components in the raw steel material are further analyzed, resulting in that Zn is contained by about 0.0020 mass % in the raw steel material of Charge B.

Experiment 2

An experiment is made to examine the influence of the Zn content on nitriding behavior on the steel sheet surface at stress-relief annealing and iron loss properties after stress-relief annealing as follows.

Steel having a component composition comprising C: 0.0027 mass %, Si: 3.6 mass %, Mn: 0.8 mass %, P: 0.01 mass %, S: 0.0018 mass %, Al: 1.1 mass %, N: 0.0021 mass %, Ti: 0.0012 mass %, Nb: 0.0008 mass %, O: 0.0022 mass %, Zn: an amount varying in the range of 0.0001 to 0.01 mass % and the remainder being Fe and inevitable impurities is melt in a vacuum melting furnace, cast into a steel ingot, and hot-rolled to form a hot-rolled sheet with a sheet thickness of 2.0 mm. The hot-rolled sheet is then subjected to hot-band annealing at 940° C. for 30 seconds, pickled, cold-rolled to form a cold-rolled sheet with a final sheet thickness of 0.25 mm. The cold-rolled sheet is subjected to a finish annealing at 780° C. for 10 seconds under an atmosphere of $H_2$: $N_2$ by vol % ratio=20:80 and coated with an insulation coating on the front and rear sides of the steel sheet under the same condition as Experiment 1 to thus produce a product sheet.

Figure 2:
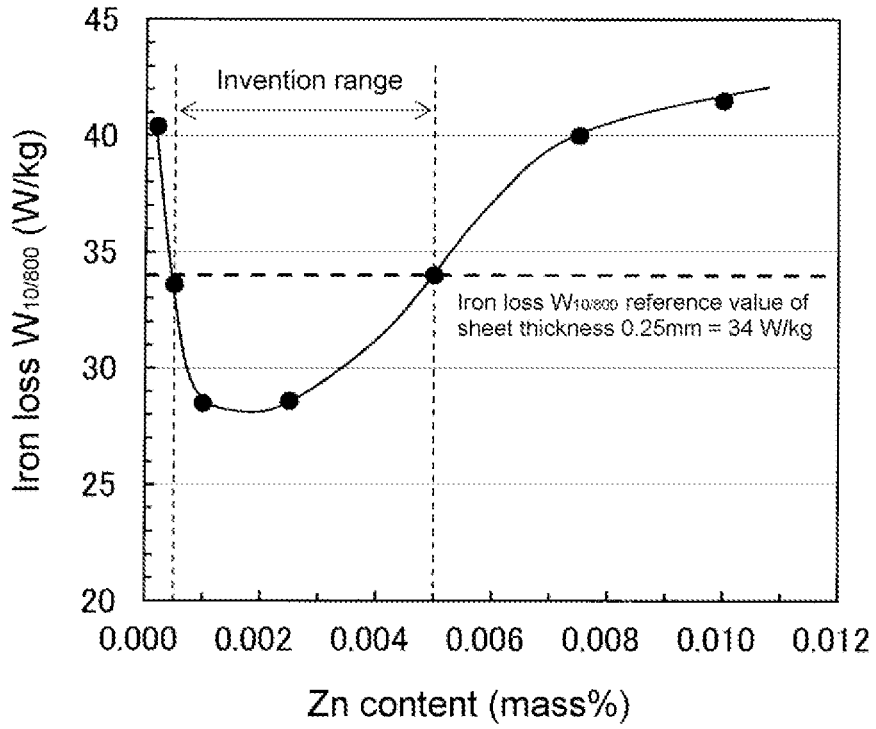
FIG. 2 is a graph showing a relation between a Zn content of steel material and an iron loss $W_{10/800}$ after stress-relief annealing.

Next, test specimens with a length of 280 mm and a width of 30 mm are cut out from the rolling direction (L direction) and the direction (C direction) perpendicular to the rolling direction of the product sheet coated with the insulation coating, and subjected to a heat treatment simulating stress-relief annealing at 830° C. for 1 hour in an atmosphere of $N_2$=100 vol %, and then the high-frequency iron loss $W_{10/800}$ in (L+C) direction is measured by the Epstein test, the results of which are shown in FIG. 2. As seen from FIG. 2, the iron loss value after the stress-relief annealing is decreased when the Zn content is in a predetermined range. In particular, when the Zn content is in the range of 0.0005 to 0.005 mass %, the iron loss value is lower than the iron loss reference value defined by the following formula (2):

$$W_{10/800}=15+80\times t \quad (2).$$

Figure 4:
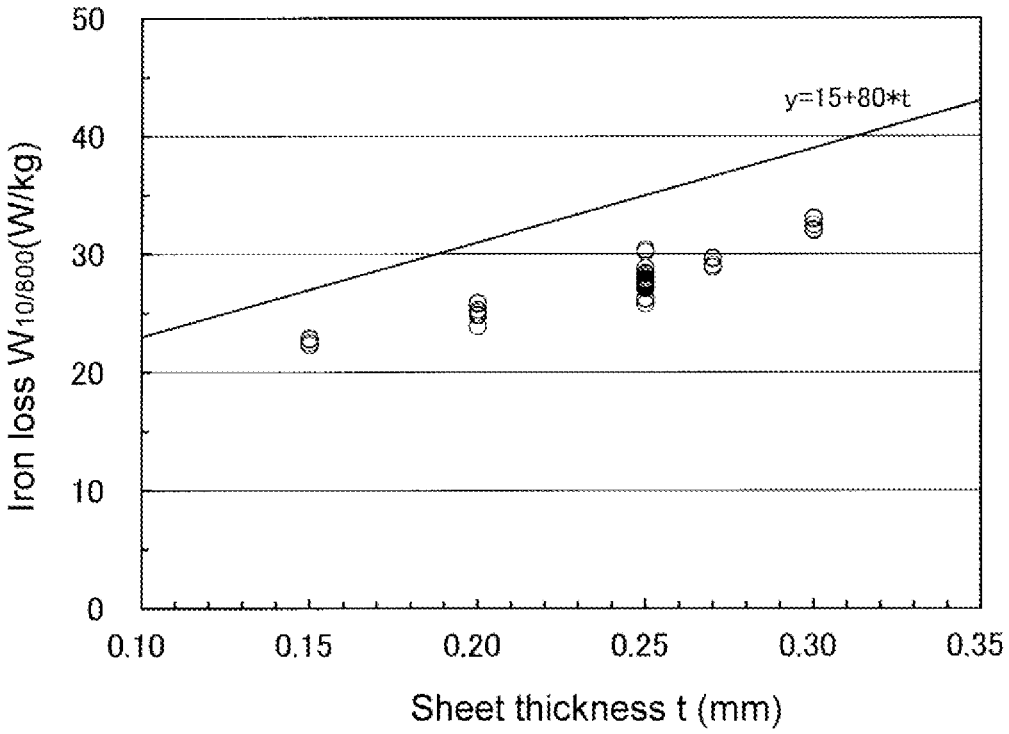
FIG. 4 is a view showing an example of a relation between a sheet thickness and an iron loss $W_{10/800}$.

The "iron loss reference value" defined by the formula (2) is the upper limit of the iron loss $W_{10/800}$ considered to be necessary to reduce heat generated in the stator core and prevent a decrease in motor efficiency. The iron loss value is largely dependent on the sheet thickness, and as shown in FIG. 4, the eddy current loss increases as the sheet thickness is thicker even for the steel sheet having the same properties. In the present invention, therefore, the iron loss reference value is determined by the formula (2) with respect to the sheet thickness. Note that FIG. 4 shows the relation between a sheet thickness and iron loss of an inventive example which will be described later in Example.

To examine the cause of the iron loss decrease by the addition of Zn, the sheet thickness section of the steel sheet after stress-relief annealing is observed by an SEM (scanning electronic microscope). The result shows in the steel sheet having an iron loss value exceeding the iron loss reference value, a large amount of finely precipitated AlN is observed in the surface layer, concretely the layer from the one-side surface to 1/20 of the sheet thickness thereof, presuming that the finely precipitated nitride may cause the increase in the iron loss.

Figure 3:
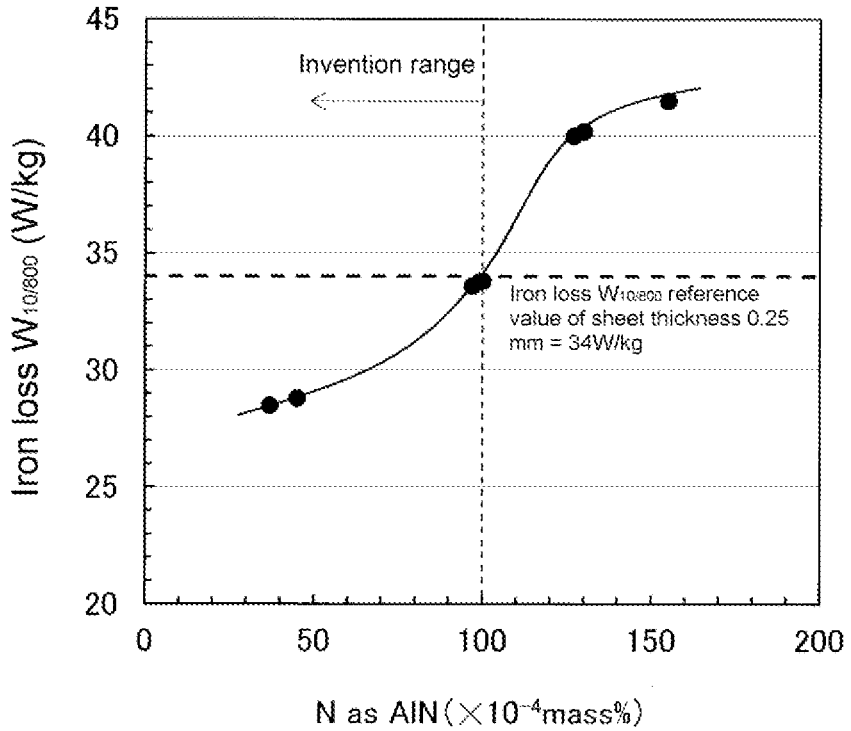
FIG. 3 is a graph showing a relation between an N concentration in a layer of 1/20 of the sheet thickness of the steel sheet and an iron loss $W_{10/800}$ after stress-relief annealing.

Further, the insulation coating is removed from the steel sheet after the stress-relief annealing, and then the N concentration (N as AlN) present as AlN in the 1/20 sheet thickness layer is analyzed by the electrolytic extraction method. FIG. 3 shows the relation between the N concentration and the iron loss $W_{10/800}$. As seen from FIG. 3, the steel sheet made of steel material with Zn added in a proper range has the concentration of N present as AlN in the 1/20 sheet thickness layer of not more than 100 massppm (0.0100 mass %). The reason why the addition of Zn into the steel raw material suppresses nitriding at stress-relief annealing is considered that a coating composed of composite compounds such as oxides containing, for example, Zn, Al, or the like is formed on the steel sheet surface at stress-relief annealing. In the invention, therefore, it is an essential requirement that the N concentration within the 1/20 sheet thickness layer of the steel sheet after stress-relief annealing is not more than 0.0100 mass %.

Next, the inventors have studied a method for suppressing nitriding on the steel sheet surface in stress-relief annealing, other than the method of adding Zn in steel raw material. As a result, they found that including at least one element selected from Sn, Sb, P, S, Se, As, Te, B, Pb, and Bi in the insulation coating to be formed on the steel sheet surface before stress-relief annealing allows the insulation coating to possess a nitriding-suppressing ability, that is, including the above element(s) in the insulation coating to mix compounds containing the element(s) in the insulation coating improves the density and adhesiveness of the insulation coating, resulting in a large improvement of that the nitriding-suppressing ability of the insulation coating.

Stress-relief annealing, particularly stress-relief annealing conducted at a high soaking temperature of not lower than 800° C. is expected to produce an effect of improving the iron loss properties by eliminating processing strain, coarsening crystal grains. Meanwhile, it has a problem of causing nitriding on the steel sheet surface layer and deteriorating magnetic properties. Against the problem, by adding a proper amount of Zn in the raw steel material (slab) as well as an element having a nitriding-suppressing effect in the insulation coating, the nitriding in the stress-relief annealing can be suppressed more effectively. That is, it has been found out that the addition of Zn in the steel material and the addition of the element having a nitriding-suppressing effect in the insulation coating for suppressing nitriding at stress-relief annealing are not sufficient when either one is used alone, and the nitriding-suppressing effect can be further increased when the both are adopted.

Second Embodiment

As described above, the first embodiment of the present invention is characterized by including a proper amount of Zn in the steel material and also including an element having a nitriding-suppressing effect in the insulation coating, i.e., imparting a nitriding-suppressing ability to the insulation coating thus to suppress nitriding on the steel sheet surface layer at stress-relief annealing. Meanwhile, the second embodiment of the present invention is characterized by forming, instead of the insulation coating of the first embodiment, an intermediate layer containing an element having a nitriding-suppressing effect between the insulation coating and an iron matrix surface of the steel sheet (thus, the insulation coating contains no element having the nitriding-suppressing effect), thereby suppressing nitriding on the steel sheet surface layer at stress-relief annealing at a high temperature.

The inventors have produced a product sheet by immersing the steel sheet after finish annealing produced in Experiment 1 in a treatment bath of zinc phosphate (PB-L47 made by Nihon Parkerizing Co., Ltd.) for 30 seconds, washing with water, drying with warm air, forming an intermediate layer on the front and rear sides of the steel sheet, and then applying an insulation coating on the intermediate layer. The coating weight of the intermediate layer is determined such that the coating thickness on one side is 30 nm. The insulation coating is formed by mixing silica sol (ST-C made by Nissan Chemical Corporation) and acrylic resin (EFD-5560 made by DIC Corporation) so as to have a solid content ratio of 90:10 by mass % ratio, adjusting the solid content concentration of the mixture to 10 mass % using deionized water to form an application liquid, applying the application liquid onto both sides of the steel sheet by a roll coater such that the coating weight of each side is 0.5 g/m$^2$, and baking the steel sheet in a hot-air furnace under a condition that the highest sheet temperature of 280° C. is reached in 30 seconds (a soaking temperature is 0 second).

Next, test specimens with a length of 280 mm and a width of 30 mm are cut out from the rolling direction (L direction) and the direction (C direction) perpendicular to the rolling direction of the product sheet coated with the insulation coating and subjected to a heat treatment simulating stress-relief annealing at 830° C. for 1 hour in an atmosphere of $N_2$=100 vol %, and then the high-frequency iron loss $W_{10/800}$ in (L+C) direction is measured by the Epstein test. As a result, similarly to FIG. 2 obtained in Experiment 2, the iron loss value is decreased when the Zn content is in the range of 0.0005 to 0.005 mass %, and the iron loss value is lower than the iron loss reference value.

The insulation coating is removed from the steel sheet surface after the stress-relief annealing, where the concentration of N (N as AlN) present as AlN in the 1/20 sheet thickness layer is analyzed by the electrolytic extraction method. The result shows that, similarly in FIG. 4, all the steel sheets having an iron loss $W_{10/800}$ of not higher than the reference value have N as AlN of not more than 100 massppm (0.0100 mass %).

As seen from these results, forming the intermediate layer containing at least one element selected from Sn, Sb, P, S, Se, As, Te, B, Pb, and Bi each having a nitriding-suppressing effect between the iron matrix surface of the steel sheet and the insulation coating can provide the same nitriding-suppressing effect as caused by including the element(s) having a nitriding-suppressing effect in the insulation coating.

In the second embodiment, since the intermediate layer has a nitriding-suppressing ability, it is possible to provide the insulation coating an insulation effect or the like other than the nitriding-suppressing ability. Although it is necessary to strengthen the bond of the insulation coating itself for better adhesiveness and scratch resistance of the insulation coating, the bond tends to be weakened when the insulation coating contains a large number of elements as in the first embodiment. In the second embodiment, however, the insulation coating is not necessary to have such a new function as nitriding-suppressing ability, and it is possible to limit the elements contained in the insulation coating, thus allowing the strong bond of the coating itself to be maintained.

In the second embodiment, the coating layer on the steel sheet surface has a multilayer structure composed of the insulation coating and the intermediate layer formed between the iron matrix surface of the steel sheet and the insulation coating, whereby a secondary effect of improving corrosion resistance and moisture resistance can be obtained. Further, the intermediate layer is expected to have an insulation effect in addition to the nitriding-suppressing effect, and hence the total coating thickness of the intermediate layer and insulation coating can be thinner than the coating thickness of the insulation coating only in the first embodiment, and hence, the intermediate layer has an effect of increasing the lamination factor (magnetic flux density of the core).

An explanation will be given on the component composition of a steel raw material (slab) used for producing a non-oriented electrical steel sheet according to the invention. There is no difference in the component composition of the steel raw material used between the first embodiment and the second embodiment of the invention.

C: Not More Than 0.0050 Mass %

C contained in a product sheet is a harmful element that forms a carbide to cause magnetic aging, deteriorating iron loss properties. Therefore, the upper limit of C contained in the steel raw material is limited to 0.0050 mass %, preferably to not more than 0.0040 mass %. The lower limit of C is not particularly defined but is preferably about 0.0001 mass % from a viewpoint of suppressing decarburization costs in the steelmaking process.

Si: 2.8 to 6.5 Mass %

Si has an effect of increasing a specific resistance of steel to reduce the iron loss and also has an effect of increasing the strength of steel by solid-solution strengthening, and hence it is contained by not less than 2.8 mass %. On the other hand, the Si content exceeding 6.5 mass % causes embrittlement of steel to make the rolling difficult, so that the upper limit of Si is set to 6.5 mass %. Si content is preferable to fall within the range of 3.0 to 6.0 mass %.

Mn: 0.1 to 2.0 Mass %

Similar to Si, Mn is an element useful for increasing the specific resistance and strength of steel. Mn fixes S to improve hot brittleness and hence is contained by not less than 0.1 mass %. On the other hand, the addition exceeding 2.0 mass % causes slab cracking and the like and deteriorates the operability in the steel-making, and thus the upper limit is set to 2.0 mass %. Mn is preferably contained in the range of 0.2 to 1.5 mass %. In particular, when Mn is contained by not less than 0.2 mass %, MnS is preferentially formed to impede the formation of ZnS, and thus the formation of a coating composed of composite compounding containing Zn oxide and the like is enhanced.

P: Not More Than 0.10 Mass %

P is an element that increases the specific resistance of steel and has a significant effect of reducing eddy current loss. P has a large solid-solution strengthening ability and thus can be added accordingly. However, the excessive addition of P causes embrittlement of steel and deterioration of cold rolling property, so that the upper limit is 0.10 mass %, preferably not more than 0.05 mass %.

S: Not More Than 0.0050 Mass %

S is formed into sulfide to form precipitates or inclusion and deteriorate productivity (hot-rolling property) and magnetic properties of the product sheet, so that smaller content is more preferable. Hence, the upper limit of S is 0.0050 mass %, more preferably not more than 0.0030 mass %.

Al: 0.3 to 2.0 Mass %

Al has an effect of increasing the specific resistance of steel and reducing the iron loss, similarly to Si. However, when the Al content exceeds 2.0 mass %, steel is embrittled, thus making rolling difficult, so that the upper limit is 2.0 mass %. On the other hand, when Al content is less than 0.3 mass %, fine nitride is formed and precipitated to rather deteriorate iron loss properties, so that the lower limit is set 0.3 mass %. Al is preferable to falls within the range of 0.4 to 1.5 mass %.

N: Not More Than 0.0050 Mass %

N is an element that forms a nitride to be precipitated and thus deteriorates the magnetic properties, so that the N content is limited to not more than 0.0050 mass %, preferably not more than 0.0040 mass %.

Ti: Not More Than 0.0030 Mass %, Nb: Not More Than 0.0030 Mass %

Ti and Nb are elements that form fine precipitates to be precipitated and increase the iron loss. When each content exceeds 0.0030 mass %, the above bad influence becomes remarkable, so that each upper limit is set to 0.0030 mass %, preferably 0.0020 mass %.

O: Not More Than 0.0050 Mass %

O: is an element that forms oxide to remain as inclusion in steel and deteriorates the magnetic properties, so the O content is limited to not more than 0.0050 mass %, preferably not more than 0.0040 mass %.

Zn: 0.0005 to 0.0050 Mass %

Zn is one of the most important elements in the invention. As having an effect of suppressing nitriding in stress-relief annealing, Zn is contained by not less than 0.0005 mass %. On the other hand, when Zn is added by more than 0.0050 mass %, sulfide is formed to increase the iron loss. Therefore, the Zn content is limited to not more than 0.0050 mass %. Zn content is preferably in the range of 0.001 to 0.004 mass %.

The steel raw material used in the present invention contains Fe and inevitable impurities as the remainder other than the aforementioned component composition and may contain, in addition to the above component composition, at least one component group selected from the following Groups A to D:

Group A: One or Two of Sn: 0.005 to 0.20 Mass % and Sb: 0.005 to 0.20 Mass %

Sn and Sb each have an effect of improving recrystallization texture and improving the magnetic flux density and iron loss properties. To obtain such effects, it is preferable to contain one or two of the elements by not less than 0.005 mass % each. However, an addition exceeding 0.20 mass % brings about the saturation of the effect. When one or two of Sn and Sb are added, therefore, each addition is in the range of 0.005 to 0.20 mass %, more preferably in the range of 0.01 to 0.1 mass %.

Group B: One or Two or More of Ca, Mg, and REM by 0.0005 to 0.020 Mass % in Total Ca, Mg, and REM have an effect of forming stable sulfide, and improving grain growth properties in stress-relief annealing. To obtain such an effect, it is preferable to add these elements by not less than 0.0005 mass % in total. On the other hand, when the element(s) are added exceeding 0.020 mass %, the above effect is saturated. Therefore, when one or two or more of these elements are added, the total addition is preferably in the range of 0.0005 to 0.020 mass %. It is more preferably in the range of 0.001 to 0.008 mass %.

Group C: One or Two or More Selected from Cu, Ni, Cr, and Co by 0.01 to 1.0 Mass % in Total Cu, Ni, Cr, and Co have effects of increasing specific resistance of steel to reduce iron loss and increasing the strength of steel. In order to obtain the above effects, it is preferable to add one or two or more selected from Cu, Ni, Cr, and Co by not less than 0.01 mass % in total. However, the addition exceeding 1 mass % brings about the increase in costs. Therefore, when one or two or more of these elements are added, the addition is preferably by 0.01 to 1.0 mass % in total, more preferably by 0.1 to 0.5 mass % in total.

Group D: One or Two Selected from Mo: 0.001 to 0.1 Mass % and W: 0.001 to 0.1 Mass %

Mo and W are elements each effective for suppressing surface defects (scab). As the steel sheet of the present invention is high alloy steel and easily oxidized on the surface, there is a concern of causing scabs resulting from surface cracking. However, the cracking can be suppressed by adding a trace amount of Mo and W being an element increasing the high-temperature strength. Such an effect is not sufficient when each content of Mo and W is less than 0.001 mass %, while it is saturated with the addition exceeding 0.1 mass %, only leading to an increase in raw material costs. When at least one of Mo and W is added, therefore, each content is preferable to be in the above range. More preferably, each content is in the range of 0.0050 to 0.050 mass %.

An explanation will be given on a method for producing a non-oriented electrical steel sheet according to the invention. A non-oriented electrical steel sheet according to the invention can be produced by a series of processes comprising: producing a raw steel material (slab) having the above-described component composition; hot-rolling the slab to form a hot-rolled sheet; subjecting the hot-rolled sheet to hot-band annealing step as required; cold-rolling the sheet to form a cold-rolled sheet with a final thickness (product sheet thickness); conducting finish annealing on the cold-rolled sheet; and forming an insulation coating thereon. Note that it is the process of forming an insulation coating on the steel sheet after finish annealing that is different between the first embodiment and second embodiment of the present invention. Details will be described below.

The steel raw material (slab) used in the production of a non-oriented electrical steel sheet according to the invention can be produced by melting steel having the aforementioned component composition conforming to the invention by a well-known refining process using a converter, an electric furnace, a vacuum degassing device or the like and then performing a usual method such as a continuous casting method or an ingot making-blooming method. Note that, a thin slab having a thickness of not more than 100 mm may be produced by a direct casting method.

Then, the slab is hot-rolled into a hot-rolled sheet by a well-known process. Moreover, the slab is usually reheated to a given temperature in a heating furnace and then subjected to hot rolling, but may be subjected to hot rolling immediately after casting without reheating. In the case of using a thin slab, it may be hot-rolled or may proceed to the subsequent step without hot rolling.

The hot-band annealing subsequent to the hot rolling is preferable to be performed at a soaking temperature in the range of 800 to 1100° C. When the soaking temperature is lower than 800° C., the effect of the hot-band annealing is too small to obtain an effect of improving magnetic properties sufficiently. On the other hand, when it exceeds 1100° C., crystal grains are coarsened to promote brittle fracture (sheet breakage) in cold rolling or become disadvantageous to the production costs. The soaking time is preferable to be not more than 3 minutes from a viewpoint of ensuring productivity. It is more preferable that the soaking temperature is 850 to 1000° C. and the soaking time is not more than 1 minute.

The steel sheet after the hot rolling or the steel sheet subjected to the hot-band annealing after the hot rolling is subjected to one cold rolling or two or more cold rollings having an intermediate annealing between each cold rolling to form a cold-rolled sheet having a final thickness. The finishing thickness (final sheet thickness) in the cold rolling is not particularly limited, but is preferably in the range of 0.10 to 0.35 mm. When the final sheet thickness is less than 0.10 mm, the productivity lowers. Meanwhile, when it exceeds 0.35 mm, the iron loss is increased as shown in FIG. 4.

The cold-rolled sheet having the final sheet thickness is then subjected to finish annealing. The finish annealing is preferably continuous annealing by soaking at a temperature of 700 to 900° C. for 1 to 300 seconds. When the soaking temperature is lower than 700° C., recrystallization is not advanced sufficiently, failing to obtain not only good magnetic properties but also a sufficient effect of the shape correction in the continuous annealing. On the other hand, when the soaking temperature exceeds 900° C., the crystal grain size is coarsened to decrease the strength of the steel sheet. From a viewpoint of securing the strength after the finish annealing required for a rotor core, it is desirable that the finish annealing is performed at a lower temperature for a shorter time as much as possible within the extent the shape correction can be conducted.

A coating agent to be an insulation coating is eventually applied to at least one side surface of the steel sheet subjected to finish annealing, heated, and baked to form the insulation coating thereon, whereby a product sheet is produced.

The insulation coating is not particularly limited to a certain type, but preferably contains an inorganic material, or an organic resin and inorganic material as the solid content. Containing inorganic material allows weldability and heat resistance to be secured, while containing organic resin allows press formability to be improved, and thus it is preferable to select either one according to the application. Moreover, in the case of including organic resin in the insulation coating, the ratio of the organic resin to the solid content after the baking is preferably in the range of not more than 70 mass %. The reason is that the ratio of the organic resin exceeding 70 mass % causes deterioration of the heat resistance.

The organic resin is not particularly limited to a certain type, and can preferably use a conventionally-used well-known one, for example, acrylic resin, alkyd resin, styrene resin, polyolefin resin, epoxy resin, phenol resin, urethane resin, polyester resin, or melamine resin. The inorganic material is not also particularly limited to a certain type, and can select from one or more selected from oxide, hydroxide, carbonate, carbide, or the like composed of Si, Al, Ti, Zr, Cr.

The coating agent of the insulation coating may also contain other components, for example, antirust, surface-active agent, lubricant, defoaming agent, oxidation inhibitor, and the like to be added for the increase in properties and coating uniformity of the insulation coating. Moreover, well-known color pigment, extender pigment, or functional pigment may be contained. These components can be contained in the range as long as the performance of the insulation coating is not made decreased, and concretely, by not more than 5 mass % of the solid content after the baking.

The insulation coating can be formed by various methods such as roll coating, flow coating, knife coating, spraying, and so on. The coating weight of the coating agent to be applied is determined by taking into account that sufficient insulation properties can be obtained, and that a sufficient nitriding-suppressing effect can be obtained. Concretely, the insulation coating is applied such that the coating weight after the baking is preferably not less than 0.1 $g/m^2$, more preferably not less than 0.2 $g/m^2$ per one-side surface. On the other hand, with the increase in the coating weight, the coating material costs are increased and the lamination factor, when formed into an iron core, is decreased, and accordingly, the upper limit of the coating weight one-side surface is preferably 10 g/m$^2$, more preferably not more than 5 g/m$^2$, further preferably not more than 2 g/m$^2$.

The baking method after the coating agent is applied is not particularly limited, and a usually-used baking method of hot-air type, infrared-heating type, or induction-heating type can be used. Also, the baking temperature has only to fall within a usually-used range, and for example, is preferably such that the highest achieving temperature of the steel sheet is 80 to 350° C. Further, the heating time from the start to the end of the heating is preferably in the range of 0.1 to 60 seconds, more preferably 1 to 30 seconds.

In the invention, it is most important to form the coating layer (nitriding-suppressing layer) having a nitriding-suppressing ability on the steel sheet surface after finish annealing. The method of forming the coating layer is different between in the first embodiment where the nitriding-suppressing ability is imparted to the insulation coating formed on the iron matrix surface of the steel sheet and in the second embodiment where the intermediate layer having the nitriding-suppressing ability is formed between the iron matrix surface of the steel sheet and the insulation coating. A detailed explanation will follow.

First Embodiment

The first embodiment of the present invention is to use an insulation coating to be formed on the iron matrix surface of a steel sheet after finish annealing as a coating layer having a nitriding-suppressing ability, and characterized by containing at least one element selected from Sn, Sb, P, S, Se, As, Te, B, Pb, and Bi in the insulation coating to impart the nitriding-suppressing ability. By containing these elements in the insulation coating, the density and adhesiveness of the insulation coating are improved to impart the nitriding-suppressing effect to the insulation coating.

The method for containing at least one element selected from Sn, Sb, P, S, Se, As, Te, B, Pb, and Bi in the insulation coating is not particularly limited, and may use a method of dissolving or dispersing the element as an inorganic compound in a coating agent for the insulating coating. Those that can be dissolved in the coating agent are dissolved while those that are difficult to be dissolved are mixed and dispersed. The inorganic compound can use an arbitrary form including oxide, carbide, hydroxide, carbonate, chromate, and phosphate. The compounding amount of these elements is preferably at least 0.001% in total by the elemental ratio in the coating after the baking. However, an excessive addition may cause deterioration of corrosion resistance and coating adhesiveness, so the upper limit is preferably about 10 mass %.

Second Embodiment

The second embodiment of the present invention is to form an insulation coating on the surface of the steel sheet after finish annealing and an intermediate layer having a nitriding-suppressing ability between the insulation coating and the iron matrix surface of the steel sheet, and characterized by containing at least one element selected from Sn, Sb, P, S, Se, As, Te, B, Pb, and Bi in the intermediate layer. By containing these elements in the intermediate layer, not only can the nitriding-suppressing effect be provided to the intermediate layer but also an insulation effect and an antirust effect can be expected. Moreover, the total thickness of the intermediate layer and insulation coating can be made thinner than the thickness of the insulation coating of the first embodiment, thus improving the lamination factor (magnetic flux density of the core).

It is necessary to strengthen the bonding of the insulation coating itself to obtain better scratch resistance of the insulation coating in the production of a core. The bonding tends to be weakened as a larger number of elements are contained in the insulation coating. In the second embodiment, however, since it is not necessary to provide the insulation coating with the nitriding-suppressing ability, the elements to be contained in the insulation coating can be limited to a minimum, so that a strong bonding can be maintained, resulting in excellent scratch resistance.

The method of forming the intermediate layer including at least one element selected from Sn, Sb, P, S, Se, As, Te, B, Pb, and Bi is not particularly limited, and for example, can apply such a method that a treatment solution containing the elements is adhered to the steel sheet surface by soaking or spraying, or applied to the steel sheet surface by roll coating or the like, and then dried. The conditions for forming the intermediate layer (temperature and time) are not limited; however, when taking into account productivity, it is preferable to select a method that can be processed in a time from 10 seconds to 10 minutes at room temperature. As a method other than the above, for example, plating process, or dry process by CVD or PVD method may be applied. In addition, the intermediate layer to be formed may be two or more layers.

Next, a motor core and a production method of the motor core will be explained.

A motor core is usually composed of a rotor core required to have high strength, and a stator core required to have a low iron loss and high magnetic flux density. In general, the former rotor core is formed by blanking a steel sheet with the insulation coating applied after finish annealing into a core shape and laminating the resultant, and used in a fixed state for the motor core, while the latter stator core is used for the motor core after a steel sheet with the insulation coating applied after finish annealing is formed into a core shape by blanking, laminated, fixed, and further subjected to stress-relief annealing to improve the magnetic properties.

The stress-relief annealing is preferably conducted at a temperature of 800 to 950° C. for 0.5 to 3 hours in an atmosphere of an inert gas such as Ar gas, $N_2$ gas, or the like. When the temperature of the stress-relief annealing is lower than 800° C. or the time thereof is shorter than 0.5 hours, the effect for the grain growth of crystal grains by the stress-relief annealing is too small to obtain a sufficient effect of improving the iron loss, possibly causing the iron loss $W_{10/800}$ after the stress-relief annealing to fail to meet the iron loss reference value defined by the above-described formula (2). On the other hand, when the temperature of the stress-relief annealing exceeds 950° C. or the time thereof exceeds 3 hours, it becomes difficult to secure the insulation between the laminated steel sheets. The more preferable condition for the stress-relief annealing is at 800 to 875° C. for 1 to 2 hours.

Since the steel sheet subjected to the stress-relief annealing contains a proper amount of Zn that has been added into the steel raw material and has the coating layer having the nitriding-suppressing ability on the steel sheet surface thus to suppress nitriding, whereby the concentration of N present as AlN (N as AlN) in the layer from the one-side surface to 1/20 of the sheet thickness of the steel sheet after the stress-relief annealing can be decreased to not more than 100 massppm (not more than 0.0100 mass %). As a result, the steel sheet of the present invention can suppress the increase in iron loss caused by AlN precipitated in the 1/20 sheet thickness layer and thus meet the iron loss reference value defined by the following formula (2) after the stress-relief annealing:

$$W_{10/800}=15+80\times t \quad (2)$$ and

Also, the steel sheet after the stress-relief annealing is subjected to an electrolytic extraction method to analyze the concentration of N present as AlN (N as AlN) in the 1/20 sheet thickness layer.

Two pieces of test specimens with a width of 100 mm and a length of 200 mm are taken out from the rolling direction (L-direction) of the product sheet coated with the insulation coating as the length direction under each condition. The two test specimens are stacked on top of each other, slid at a relative speed of 2 cm/s for 10 seconds while applying a pressure of 1 kg/cm$^2$ thereto, and visually observed to determine the presence or absence of a scratch on the surface of the test specimens, from which the scratch resistance is evaluated according to the evaluation criteria below.

<Scratch Resistance Evaluation Criteria>

◎: Almost no scratch is observed (acceptable)

○: A few scratches are observed (acceptable)

x: A scratch is clearly observed (rejected)

Moreover, two pieces of test specimens with a width of 100 mm and a length of 200 mm are taken out from the rolling direction (L-direction) of the product sheet coated with the insulation coating as the length direction under each condition. An adhesive cellophane tape is attached to the surface to be tested, and the steel sheet is subjected to 180° bending using a round bar with a 5 mm-diameter with the surface to be tested as the compression side. Thereafter, the adhesive cellophane tape is taken off and the coating stripped area is calculated to evaluate the coating adhesiveness according to the criteria below.

<Coating Adhesiveness Evaluation Criteria>

◎: Stripped area of the coating <5% (acceptable)

○: 5%<stripped area of the coating <10% (acceptable)

x: Stripped area of the coating ≥10% (rejected)

Example 1

Slabs having various component compositions shown in Table 1 and the remainder being Fe and inevitable impurities are heated to a temperature at 1120° C. for 30 minutes, hot-rolled to each form a hot-rolled sheet having a sheet thickness of 2.0 mm, subjected to hot-band annealing at 930° C. for 30 seconds, pickled for descaling and cold-rolled to form a cold-rolled sheet having the final sheet thickness shown in Table 2. Then, the cold-rolled sheet is subjected to finish annealing at 820° C. for 10 seconds under an atmosphere of $H_2$: $N_2$=20:80 by vol % ratio, coated with a coating agent for insulation coating prepared by combining the components A to G shown in Table 3 in configurations shown in Table 2 on both sides of the steel sheet by a roll coater so that the coating weight per one side has the value shown in Table 2, and baked in a hot-air drying furnace under the conditions shown in Table 2 thus to produce a product sheet.

Test specimens with a length of 280 mm and a width of 30 mm are taken out from the rolling direction (L-direction) and the direction perpendicular to the rolling direction (C-direction) of the thus-obtained product sheet coated with the insulation coating, and each subjected to stress-relief annealing under conditions shown in Table 2 in an atmosphere of N2=100 vol % under the conditions shown in Table 2 to measure iron loss $W_{10/800}$ by the Epstein test.

TABLE 1

| Steel sheet | Component composition (mass %) | | | | | | | | | | | |
|---|---|---|---|---|---|---|---|---|---|---|---|---|
| No | C | Si | Mn | P | S | Al | Zn | Ti | Nb | O | N | Sn |
| 1 | 0.0025 | 3.6 | 0.4 | 0.01 | 0.0018 | 0.9 | 0.0021 | 0.0011 | 0.0009 | 0.0024 | 0.0022 | 0.03 |
| 2 | 0.0025 | 3.6 | 0.4 | 0.01 | 0.0018 | 0.9 | 0.0021 | 0.0011 | 0.0009 | 0.0024 | 0.0022 | 0.03 |
| 3 | 0.0025 | 3.6 | 0.4 | 0.01 | 0.0018 | 0.9 | 0.0021 | 0.0011 | 0.0009 | 0.0024 | 0.0022 | 0.03 |
| 4 | 0.0025 | 3.6 | 0.4 | 0.01 | 0.0018 | 0.9 | 0.0021 | 0.0011 | 0.0009 | 0.0024 | 0.0022 | 0.03 |
| 5 | 0.0025 | 3.6 | 0.4 | 0.01 | 0.0018 | 0.9 | 0.0021 | 0.0011 | 0.0009 | 0.0024 | 0.0022 | 0.03 |
| 6 | 0.0025 | 3.6 | 0.4 | 0.01 | 0.0018 | 0.9 | 0.0058 | 0.0011 | 0.0009 | 0.0024 | 0.0022 | 0.03 |
| 7 | 0.0025 | 3.6 | 0.4 | 0.01 | 0.0018 | 0.9 | 0.0003 | 0.0011 | 0.0009 | 0.0024 | 0.0022 | 0.03 |
| 8 | 0.0021 | 3.8 | 0.5 | 0.01 | 0.0019 | 0.6 | 0.0029 | 0.0013 | 0.0011 | 0.0025 | 0.0024 | — |
| 9 | 0.0021 | 3.8 | 0.5 | 0.01 | 0.0019 | 0.6 | 0.0007 | 0.0013 | 0.0011 | 0.0025 | 0.0024 | — |
| 10 | 0.0021 | 3.8 | 0.5 | 0.01 | 0.0019 | 0.6 | 0.0043 | 0.0013 | 0.0011 | 0.0025 | 0.0024 | — |
| 11 | 0.0021 | 3.8 | 0.5 | 0.01 | 0.0019 | 0.6 | 0.0029 | 0.0013 | 0.0011 | 0.0025 | 0.0024 | — |
| 12 | 0.0021 | 3.8 | 0.5 | 0.01 | 0.0019 | 0.6 | 0.0029 | 0.0013 | 0.0011 | 0.0025 | 0.0024 | — |
| 13 | 0.0021 | 3.8 | 0.5 | 0.01 | 0.0019 | 0.6 | 0.0029 | 0.0013 | 0.0011 | 0.0025 | 0.0024 | — |
| 14 | 0.0028 | 3.2 | 0.8 | 0.01 | 0.0024 | 1.2 | 0.0024 | 0.0008 | 0.0012 | 0.0021 | 0.0019 | 0.04 |
| 15 | 0.0028 | 3.2 | 0.8 | 0.01 | 0.0024 | 1.8 | 0.0024 | 0.0008 | 0.0012 | 0.0021 | 0.0020 | 0.04 |
| 16 | 0.0025 | 3.6 | 2.5 | 0.01 | 0.0018 | 0.9 | 0.0021 | 0.0011 | 0.0009 | 0.0024 | 0.0022 | 0.03 |
| 17 | 0.0025 | 3.6 | 0.4 | 0.01 | 0.0018 | 2.5 | 0.0021 | 0.0011 | 0.0009 | 0.0024 | 0.0022 | 0.03 |
| 18 | 0.0019 | 4.2 | 0.3 | 0.01 | 0.0015 | 0.3 | 0.0026 | 0.0014 | 0.0012 | 0.0019 | 0.0027 | — |
| 19 | 0.0019 | 5.6 | 0.3 | 0.01 | 0.0015 | 0.3 | 0.0027 | 0.0014 | 0.0012 | 0.0019 | 0.0027 | — |
| 20 | 0.0025 | 7.2 | 0.4 | 0.01 | 0.0018 | 0.9 | 0.0021 | 0.0011 | 0.0009 | 0.0024 | 0.0022 | 0.03 |
| 21 | 0.0021 | 4.0 | 0.4 | 0.01 | 0.0026 | 0.6 | 0.0032 | 0.0011 | 0.0013 | 0.0028 | 0.0024 | 0.03 |
| 22 | 0.0021 | 4.1 | 0.4 | 0.01 | 0.0026 | 0.6 | 0.0032 | 0.0011 | 0.0013 | 0.0028 | 0.0024 | 0.03 |
| 23 | 0.0025 | 3.6 | 0.4 | 0.25 | 0.0018 | 0.9 | 0.0021 | 0.0011 | 0.0009 | 0.0024 | 0.0022 | 0.03 |
| 24 | 0.0024 | 3.4 | 1.2 | 0.01 | 0.0019 | 0.9 | 0.0024 | 0.0016 | 0.0014 | 0.0027 | 0.0021 | 0.03 |
| 25 | 0.0024 | 3.3 | 1.8 | 0.01 | 0.0019 | 0.7 | 0.0024 | 0.0016 | 0.0014 | 0.0027 | 0.0021 | 0.03 |
| 26 | 0.0018 | 3.5 | 0.2 | 0.01 | 0.0015 | 0.9 | 0.0021 | 0.0012 | 0.0009 | 0.0027 | 0.0021 | — |
| 27 | 0.0025 | 3.6 | 0.4 | 0.01 | 0.0059 | 0.9 | 0.0021 | 0.0011 | 0.0009 | 0.0024 | 0.0022 | 0.03 |
| 28 | 0.0025 | 3.6 | 0.4 | 0.01 | 0.0018 | 0.9 | 0.0021 | 0.0041 | 0.0009 | 0.0024 | 0.0022 | 0.03 |
| 29 | 0.0025 | 3.6 | 0.4 | 0.01 | 0.0018 | 0.9 | 0.0021 | 0.0011 | 0.0038 | 0.0024 | 0.0022 | 0.03 |
| 30 | 0.0025 | 3.6 | 0.4 | 0.01 | 0.0018 | 0.9 | 0.0021 | 0.0011 | 0.0009 | 0.0064 | 0.0022 | 0.03 |
| 31 | 0.0025 | 3.6 | 0.4 | 0.01 | 0.0018 | 0.9 | 0.0021 | 0.0011 | 0.0009 | 0.0024 | 0.0065 | 0.03 |
| 32 | 0.0021 | 4.1 | 0.5 | 0.01 | 0.0023 | 0.7 | 0.0024 | 0.0012 | 0.0013 | 0.0023 | 0.0022 | 0.03 |

TABLE 1-continued

| | | | | | | | | | | | | |
|---|---|---|---|---|---|---|---|---|---|---|---|---|
| 33 | 0.0021 | 4.1 | 0.5 | 0.01 | 0.0023 | 0.7 | 0.0024 | 0.0012 | 0.0013 | 0.0023 | 0.0022 | 0.03 |
| 34 | 0.0021 | 4.1 | 0.5 | 0.01 | 0.0023 | 0.7 | 0.0024 | 0.0012 | 0.0013 | 0.0023 | 0.0022 | 0.03 |
| 35 | 0.0026 | 3.4 | 0.9 | 0.01 | 0.0026 | 1.4 | 0.0019 | 0.0018 | 0.0012 | 0.0021 | 0.0023 | 0.03 |
| 36 | 0.0026 | 3.4 | 0.9 | 0.01 | 0.0026 | 1.4 | 0.0019 | 0.0018 | 0.0012 | 0.0021 | 0.0023 | 0.03 |
| 37 | 0.0026 | 3.4 | 0.9 | 0.01 | 0.0026 | 1.4 | 0.0019 | 0.0018 | 0.0012 | 0.0021 | 0.0023 | 0.03 |
| 38 | 0.0025 | 3.7 | 0.8 | 0.01 | 0.0021 | 0.8 | 0.0021 | 0.0013 | 0.0013 | 0.0032 | 0.0031 | 0.03 |
| 39 | 0.0025 | 3.6 | 0.4 | 0.01 | 0.0018 | 0.9 | 0.0021 | 0.0011 | 0.0009 | 0.0024 | 0.0022 | 0.015 |
| 40 | 0.0025 | 3.6 | 0.4 | 0.01 | 0.0018 | 0.9 | 0.0021 | 0.0011 | 0.0009 | 0.0024 | 0.0022 | 0.015 |
| 41 | 0.0025 | 3.6 | 0.4 | 0.01 | 0.0018 | 0.9 | 0.0021 | 0.0011 | 0.0009 | 0.0024 | 0.0022 | 0.015 |
| 42 | 0.0021 | 3.8 | 0.5 | 0.01 | 0.0019 | 0.6 | 0.0029 | 0.0013 | 0.0011 | 0.0025 | 0.0024 | — |
| 43 | 0.0021 | 3.8 | 0.5 | 0.01 | 0.0019 | 0.6 | 0.0029 | 0.0013 | 0.0011 | 0.0025 | 0.0024 | — |
| 44 | 0.0021 | 3.8 | 0.5 | 0.01 | 0.0019 | 0.6 | 0.0029 | 0.0013 | 0.0011 | 0.0025 | 0.0024 | — |
| 45 | 0.0021 | 3.8 | 0.5 | 0.01 | 0.0019 | 0.6 | 0.0029 | 0.0013 | 0.0011 | 0.0025 | 0.0024 | — |
| 46 | 0.0021 | 3.8 | 0.5 | 0.01 | 0.0019 | 0.6 | 0.0029 | 0.0013 | 0.0011 | 0.0025 | 0.0024 | — |
| 47 | 0.0021 | 3.8 | 0.5 | 0.01 | 0.0019 | 0.6 | 0.0029 | 0.0013 | 0.0011 | 0.0025 | 0.0024 | — |
| 48 | 0.0021 | 4.1 | 0.5 | 0.01 | 0.0023 | 0.7 | 0.0024 | 0.0012 | 0.0013 | 0.0023 | 0.0022 | 0.03 |
| 49 | 0.0021 | 4.1 | 0.5 | 0.01 | 0.0023 | 0.7 | 0.0024 | 0.0012 | 0.0013 | 0.0023 | 0.0022 | 0.03 |
| 50 | 0.0021 | 4.1 | 0.5 | 0.01 | 0.0023 | 0.7 | 0.0024 | 0.0012 | 0.0013 | 0.0023 | 0.0022 | 0.03 |
| 51 | 0.0021 | 4.1 | 0.5 | 0.01 | 0.0023 | 0.7 | 0.0024 | 0.0012 | 0.0013 | 0.0023 | 0.0022 | 0.03 |
| 52 | 0.0028 | 3.2 | 0.8 | 0.01 | 0.0024 | 1.2 | 0.0024 | 0.0008 | 0.0012 | 0.0021 | 0.0019 | 0.04 |
| 53 | 0.0028 | 3.2 | 0.8 | 0.01 | 0.0024 | 1.2 | 0.0024 | 0.0008 | 0.0012 | 0.0021 | 0.0019 | 0.04 |
| 54 | 0.0028 | 3.2 | 0.8 | 0.01 | 0.0024 | 1.2 | 0.0024 | 0.0008 | 0.0012 | 0.0021 | 0.0019 | 0.04 |
| 55 | 0.0028 | 3.2 | 0.8 | 0.01 | 0.0024 | 1.2 | 0.0024 | 0.0008 | 0.0012 | 0.0021 | 0.0019 | 0.04 |
| 56 | 0.0026 | 3.4 | 0.9 | 0.01 | 0.0026 | 1.4 | 0.0019 | 0.0018 | 0.0012 | 0.0021 | 0.0023 | 0.03 |
| 57 | 0.0026 | 3.4 | 0.9 | 0.01 | 0.0026 | 1.4 | 0.0019 | 0.0018 | 0.0012 | 0.0021 | 0.0023 | 0.03 |
| 58 | 0.0026 | 3.4 | 0.9 | 0.01 | 0.0026 | 1.4 | 0.0019 | 0.0018 | 0.0012 | 0.0021 | 0.0023 | 0.03 |
| 59 | 0.0026 | 3.4 | 0.9 | 0.01 | 0.0026 | 1.4 | 0.0019 | 0.0018 | 0.0012 | 0.0021 | 0.0023 | 0.03 |
| 60 | 0.0024 | 3.4 | 1.2 | 0.01 | 0.0019 | 0.9 | 0.0024 | 0.0016 | 0.0014 | 0.0027 | 0.0021 | 0.03 |
| 61 | 0.0024 | 3.4 | 1.2 | 0.01 | 0.0019 | 0.9 | 0.0024 | 0.0016 | 0.0014 | 0.0027 | 0.0021 | 0.03 |
| 62 | 0.0024 | 3.4 | 1.2 | 0.01 | 0.0019 | 0.9 | 0.0024 | 0.0016 | 0.0014 | 0.0027 | 0.0021 | 0.03 |
| 63 | 0.0024 | 3.4 | 1.2 | 0.01 | 0.0019 | 0.9 | 0.0024 | 0.0016 | 0.0014 | 0.0027 | 0.0021 | 0.03 |
| 64 | 0.0028 | 3.2 | 0.8 | 0.01 | 0.0024 | 1.8 | 0.0024 | 0.0008 | 0.0012 | 0.0021 | 0.0020 | 0.04 |
| 65 | 0.0028 | 3.2 | 0.8 | 0.01 | 0.0024 | 1.8 | 0.0024 | 0.0008 | 0.0012 | 0.0021 | 0.0020 | 0.04 |
| 66 | 0.0028 | 3.2 | 0.8 | 0.01 | 0.0024 | 1.8 | 0.0024 | 0.0008 | 0.0012 | 0.0021 | 0.0020 | 0.04 |
| 67 | 0.0028 | 3.2 | 0.8 | 0.01 | 0.0024 | 1.8 | 0.0024 | 0.0008 | 0.0012 | 0.0021 | 0.0020 | 0.04 |
| 68 | 0.0025 | 3.6 | 0.4 | 0.01 | 0.0018 | 0.9 | 0.0021 | 0.0011 | 0.0009 | 0.0024 | 0.0022 | 0.03 |
| 69 | 0.0025 | 3.6 | 0.4 | 0.01 | 0.0018 | 0.9 | 0.0021 | 0.0011 | 0.0009 | 0.0024 | 0.0022 | 0.03 |
| 70 | 0.0025 | 3.6 | 0.4 | 0.01 | 0.0018 | 0.9 | 0.0021 | 0.0011 | 0.0009 | 0.0024 | 0.0022 | 0.03 |
| 71 | 0.0025 | 3.6 | 0.4 | 0.01 | 0.0018 | 0.9 | 0.0021 | 0.0011 | 0.0009 | 0.0024 | 0.0022 | 0.03 |
| 72 | 0.0025 | 3.6 | 0.4 | 0.01 | 0.0018 | 0.9 | 0.0021 | 0.0011 | 0.0009 | 0.0024 | 0.0022 | 0.03 |
| 73 | 0.0025 | 3.6 | 0.4 | 0.01 | 0.0018 | 0.9 | 0.0021 | 0.0011 | 0.0009 | 0.0024 | 0.0022 | 0.03 |
| 74 | 0.0025 | 3.6 | 0.4 | 0.01 | 0.0018 | 0.9 | 0.0021 | 0.0011 | 0.0009 | 0.0024 | 0.0022 | — |

| Steel sheet No | Component composition (mass %) Sb | Ca, Mg, REM | Cu, Ni, Cr, Co | Mo, W | Remarks |
|---|---|---|---|---|---|
| 1 | — | — | — | — | Inventive steel |
| 2 | — | — | — | — | Inventive steel |
| 3 | — | — | — | — | Inventive steel |
| 4 | — | — | — | — | Inventive steel |
| 5 | — | — | — | — | Inventive steel |
| 6 | — | — | — | — | Comparative steel |
| 7 | — | — | — | — | Comparative steel |
| 8 | — | — | — | — | Inventive steel |
| 9 | — | — | — | — | Inventive steel |
| 10 | — | — | — | — | Inventive steel |
| 11 | — | — | — | — | Inventive steel |
| 12 | — | — | — | — | Inventive steel |
| 13 | — | — | — | — | Inventive steel |
| 14 | — | — | — | — | Inventive steel |
| 15 | — | — | — | — | Inventive steel |
| 16 | — | — | — | — | Comparative steel |
| 17 | — | — | — | — | Comparative steel |
| 18 | 0.01 | — | — | — | Inventive steel |
| 19 | — | — | — | — | Inventive steel |
| 20 | — | — | — | — | Comparative steel |
| 21 | — | — | — | — | Inventive steel |
| 22 | — | — | — | — | Inventive steel |
| 23 | — | — | — | — | Comparative steel |
| 24 | — | — | — | — | Inventive steel |
| 25 | — | — | — | — | Inventive steel |
| 26 | 0.05 | — | — | — | Inventive steel |
| 27 | — | — | — | — | Comparative steel |
| 28 | — | — | — | — | Comparative steel |
| 29 | — | — | — | — | Comparative steel |
| 30 | — | — | — | — | Comparative steel |
| 31 | — | — | — | — | Comparative steel |
| 32 | — | — | — | — | Inventive steel |

TABLE 1-continued

| | | | | | |
|---|---|---|---|---|---|
| 33 | — | — | — | — | Inventive steel |
| 34 | — | — | — | — | Inventive steel |
| 35 | — | — | — | — | Inventive steel |
| 36 | — | — | — | — | Inventive steel |
| 37 | — | — | — | — | Inventive steel |
| 38 | — | — | — | — | Inventive steel |
| 39 | 0.015 | — | — | — | Inventive steel |
| 40 | 0.015 | — | — | — | Inventive steel |
| 41 | 0.015 | — | — | — | Inventive steel |
| 42 | — | Ca: 0.0032 | — | — | Inventive steel |
| 43 | — | Mg: 0.0023 | — | — | Inventive steel |
| 44 | — | REM: 0.0065 | — | — | Inventive steel |
| 45 | — | Ca: 0.0021, Mg: 0.0032 | — | — | Inventive steel |
| 46 | — | Ca: 0.0015, REM: 0.0025 | — | — | Inventive steel |
| 47 | — | Mg: 0.0015, REM: 0.0035 | — | — | Inventive steel |
| 48 | — | — | Cu: 0.05 | — | Inventive steel |
| 49 | — | — | Cu: 0.1 | — | Inventive steel |
| 50 | — | — | Cu: 0.5 | — | Inventive steel |
| 51 | — | — | Cu: 0.9 | — | Inventive steel |
| 52 | — | — | Cr: 0.05 | — | Inventive steel |
| 53 | — | — | Cr: 0.1 | — | Inventive steel |
| 54 | — | — | Cr: 0.5 | — | Inventive steel |
| 55 | — | — | Cr: 0.9 | — | Inventive steel |
| 56 | — | — | Ni: 0.05 | — | Inventive steel |
| 57 | — | — | Ni: 0.1 | — | Inventive steel |
| 58 | — | — | Ni: 0.5 | — | Inventive steel |
| 59 | — | — | Ni: 0.9 | — | Inventive steel |
| 60 | — | — | Co: 0.05 | — | Inventive steel |
| 61 | — | — | Co: 0.1 | — | Inventive steel |
| 62 | — | — | Co: 0.5 | — | Inventive steel |
| 63 | — | — | Co: 0.9 | — | Inventive steel |
| 64 | — | — | Cu: 0.3, Ni: 0.3 | — | Inventive steel |
| 65 | — | — | Cr: 0.3, Co: 0.3 | — | Inventive steel |
| 66 | — | — | Ni: 0.3, Co: 0.3 | — | Inventive steel |
| 67 | — | — | Cu: 0.3, Co: 0.3 | — | Inventive steel |
| 68 | — | — | — | Mo: 0.0025 | Inventive steel |
| 69 | — | — | — | Mo: 0.05 | Inventive steel |
| 70 | — | — | — | W: 0.0025 | Inventive steel |
| 71 | — | — | — | W: 0.06 | Inventive steel |
| 72 | — | — | — | Mo: 0.0025, W: 0.0025 | Inventive steel |
| 73 | — | Ca: 0.0024 | — | Mo: 0.0025 | Inventive steel |
| 74 | — | Ca: 0.0024 | — | Mo: 0.0025 | Inventive steel |

TABLE 2

| Steel sheet No | Final sheet thickness t (mm) | Insulation coating: Inorganic A | Inorganic B | Inorganic C | Inorganic D | Organic E | Organic F | Others G | Solid content concentration (mass %) | Coating weight (g/m$^2$) | Baking time (s) | Baking temp. (° C.) | Stress-relief annealing conditions: Temp. (° C.) | Time (hr) | N as AlN (mass %) in 1/20 sheet thickness layer after stress-relief annealing |
|---|---|---|---|---|---|---|---|---|---|---|---|---|---|---|---|
| 1 | 0.25 | ○ | — | — | — | ○ | — | — | 10 | 0.5 | 20 | 270 | 850 | 1 | 0.0035 |
| 2 | 0.25 | ○ | — | — | — | ○ | — | — | 10 | 0.5 | 20 | 270 | 775 | 1 | 0.0034 |
| 3 | 0.30 | ○ | — | — | — | ○ | — | — | 10 | 0.5 | 20 | 270 | 850 | 1 | 0.0032 |
| 4 | 0.20 | ○ | — | — | — | ○ | — | ○ | 10 | 0.5 | 20 | 270 | 850 | 1 | 0.0034 |
| 5 | 0.15 | ○ | — | — | — | ○ | — | ○ | 10 | 0.5 | 20 | 270 | 850 | 1 | 0.0037 |
| 6 | 0.15 | ○ | — | — | — | ○ | — | ○ | 10 | 0.5 | 20 | 270 | 850 | 1 | 0.0042 |
| 7 | 0.25 | ○ | — | — | — | ○ | — | ○ | 10 | 0.5 | 20 | 270 | 850 | 1 | 0.0140 |
| 8 | 0.25 | ○ | — | — | — | ○ | — | — | 10 | 0.5 | 20 | 270 | 825 | 1 | 0.0024 |
| 9 | 0.25 | ○ | — | — | — | ○ | — | — | 10 | 0.5 | 20 | 270 | 825 | 1 | 0.0038 |
| 10 | 0.25 | ○ | — | — | — | ○ | — | — | 10 | 0.5 | 20 | 270 | 825 | 1 | 0.0031 |
| 11 | 0.20 | ○ | — | — | — | ○ | — | — | 10 | 0.5 | 20 | 270 | 825 | 1 | 0.0024 |
| 12 | 0.25 | ○ | — | — | — | ○ | — | — | 10 | 0.5 | 20 | 270 | 700 | 1 | 0.0039 |
| 13 | 0.25 | ○ | — | — | — | ○ | — | — | 10 | 0.5 | 20 | 270 | 800 | 2 | 0.0041 |

TABLE 2-continued

| | | | | | | | | | | | | | | | |
|---|---|---|---|---|---|---|---|---|---|---|---|---|---|---|---|
| 14 | 0.27 | ○ | — | — | — | ○ | — | — | 10 | 0.5 | 20 | 270 | 825 | 1 | 0.0049 |
| 15 | 0.25 | ○ | — | — | — | ○ | — | — | 10 | 0.5 | 20 | 270 | 825 | 1 | 0.0045 |
| 16 | — | ○ | — | — | — | ○ | — | — | — | — | — | — | — | — | — |
| 17 | — | ○ | — | — | — | ○ | — | — | — | — | — | — | — | — | — |
| 18 | 0.25 | ○ | — | — | — | ○ | — | — | 10 | 0.5 | 20 | 270 | 900 | 1 | 0.0065 |
| 19 | 0.25 | ○ | — | — | — | ○ | — | — | 10 | 0.5 | 20 | 270 | 900 | 1 | 0.0064 |
| 20 | — | ○ | — | — | — | ○ | — | — | — | — | — | — | — | — | — |
| 21 | 0.30 | ○ | — | — | — | — | ○ | — | 10 | 0.5 | 20 | 270 | 825 | 1 | 0.0039 |
| 22 | 0.20 | ○ | — | — | — | — | ○ | — | 10 | 0.5 | 20 | 270 | 825 | 1 | 0.0038 |
| 23 | — | ○ | — | — | — | — | ○ | — | — | — | — | — | — | — | — |
| 24 | 0.25 | ○ | — | — | — | — | ○ | — | 10 | 0.5 | 20 | 270 | 850 | 1 | 0.0039 |
| 25 | 0.25 | ○ | — | — | — | — | ○ | ○ | 10 | 0.5 | 20 | 270 | 850 | 1 | 0.0045 |
| 26 | 0.27 | ○ | — | — | — | — | ○ | — | 10 | 0.5 | 20 | 270 | 825 | 1 | 0.0029 |
| 27 | 0.25 | ○ | ○ | — | — | ○ | — | — | 10 | 0.5 | 20 | 270 | 800 | 1 | 0.0045 |
| 28 | 0.25 | ○ | ○ | — | — | ○ | — | — | 10 | 0.5 | 20 | 270 | 800 | 1 | 0.0041 |
| 29 | 0.25 | ○ | ○ | — | — | ○ | — | — | 10 | 0.5 | 20 | 270 | 800 | 1 | 0.0043 |
| 30 | 0.25 | ○ | ○ | — | — | ○ | — | ○ | 10 | 0.5 | 20 | 270 | 800 | 1 | 0.0044 |
| 31 | 0.25 | ○ | ○ | — | — | ○ | — | — | 10 | 0.5 | 20 | 270 | 800 | 1 | 0.0081 |
| 32 | 0.20 | ○ | ○ | — | — | — | ○ | ○ | 10 | 0.5 | 20 | 270 | 830 | 1 | 0.0051 |
| 33 | 0.25 | — | ○ | — | — | — | ○ | ○ | 10 | 0.5 | 20 | 270 | 830 | 1 | 0.0053 |
| 34 | 0.30 | — | ○ | — | — | — | ○ | ○ | 10 | 0.5 | 20 | 270 | 830 | 1 | 0.0059 |
| 35 | 0.15 | — | ○ | — | — | — | ○ | — | 10 | 0.5 | 20 | 270 | 830 | 1 | 0.0054 |
| 36 | 0.20 | — | ○ | — | — | ○ | — | — | 10 | 0.5 | 20 | 270 | 900 | 0.5 | 0.0051 |
| 37 | 0.25 | — | ○ | — | — | ○ | — | — | 10 | 0.5 | 20 | 270 | 850 | 1 | 0.0053 |
| 38 | 0.25 | — | ○ | — | — | — | ○ | — | 10 | 0.5 | 20 | 270 | 850 | 2 | 0.0052 |
| 39 | 0.25 | — | — | — | — | ○ | — | — | 10 | 0.5 | 20 | 270 | 850 | 1 | 0.0031 |
| 40 | 0.25 | — | — | ○ | — | ○ | — | — | 10 | 0.5 | 20 | 270 | 830 | 1 | 0.0032 |
| 41 | 0.25 | — | — | — | ○ | ○ | — | — | 10 | 0.5 | 20 | 270 | 830 | 1 | 0.0032 |
| 42 | 0.25 | ○ | — | — | — | ○ | — | — | 10 | 0.5 | 20 | 270 | 825 | 1 | 0.0024 |
| 43 | 0.25 | ○ | — | — | — | ○ | — | — | 10 | 0.5 | 20 | 270 | 825 | 1 | 0.0024 |
| 44 | 0.25 | ○ | — | — | — | ○ | — | — | 10 | 0.5 | 20 | 270 | 825 | 1 | 0.0024 |
| 45 | 0.25 | ○ | — | — | — | ○ | — | — | 10 | 0.5 | 20 | 270 | 825 | 1 | 0.0024 |
| 46 | 0.25 | ○ | — | — | — | ○ | — | — | 10 | 0.5 | 20 | 270 | 825 | 1 | 0.0024 |
| 47 | 0.25 | ○ | — | — | — | ○ | — | — | 10 | 0.5 | 20 | 270 | 825 | 1 | 0.0024 |
| 48 | 0.20 | ○ | ○ | — | — | — | ○ | ○ | 10 | 0.5 | 20 | 270 | 830 | 1 | 0.0051 |
| 49 | 0.20 | ○ | ○ | — | — | — | ○ | ○ | 10 | 0.5 | 20 | 270 | 830 | 1 | 0.0051 |
| 50 | 0.20 | ○ | ○ | — | — | — | ○ | ○ | 10 | 0.5 | 20 | 270 | 830 | 1 | 0.0051 |
| 51 | 0.20 | ○ | ○ | — | — | — | ○ | ○ | 10 | 0.5 | 20 | 270 | 830 | 1 | 0.0051 |
| 52 | 0.27 | ○ | — | — | — | ○ | — | — | 10 | 0.5 | 20 | 270 | 825 | 1 | 0.0049 |
| 53 | 0.27 | ○ | — | — | — | ○ | — | — | 10 | 0.5 | 20 | 270 | 825 | 1 | 0.0049 |
| 54 | 0.27 | ○ | — | — | — | ○ | — | — | 10 | 0.5 | 20 | 270 | 825 | 1 | 0.0049 |
| 55 | 0.27 | ○ | — | — | — | ○ | — | — | 10 | 0.5 | 20 | 270 | 825 | 1 | 0.0049 |
| 56 | 0.25 | — | ○ | — | — | ○ | — | — | 10 | 0.5 | 20 | 270 | 850 | 1 | 0.0053 |
| 57 | 0.25 | — | ○ | — | — | ○ | — | — | 10 | 0.5 | 20 | 270 | 850 | 1 | 0.0053 |
| 58 | 0.25 | — | ○ | — | — | ○ | — | — | 10 | 0.5 | 20 | 270 | 850 | 1 | 0.0053 |
| 59 | 0.25 | — | ○ | — | — | ○ | — | — | 10 | 0.5 | 20 | 270 | 850 | 1 | 0.0053 |
| 60 | 0.25 | ○ | — | — | — | — | ○ | — | 10 | 0.5 | 20 | 270 | 850 | 1 | 0.0039 |
| 61 | 0.25 | ○ | — | — | — | — | ○ | — | 10 | 0.5 | 20 | 270 | 850 | 1 | 0.0039 |
| 62 | 0.25 | ○ | — | — | — | — | ○ | — | 10 | 0.5 | 20 | 270 | 850 | 1 | 0.0039 |
| 63 | 0.25 | ○ | — | — | — | — | ○ | — | 10 | 0.5 | 20 | 270 | 850 | 1 | 0.0039 |
| 64 | 0.25 | ○ | — | — | — | ○ | — | — | 10 | 0.5 | 20 | 270 | 825 | 1 | 0.0045 |
| 65 | 0.25 | ○ | — | — | — | ○ | — | — | 10 | 0.5 | 20 | 270 | 825 | 1 | 0.0045 |
| 66 | 0.25 | ○ | — | — | — | ○ | — | — | 10 | 0.5 | 20 | 270 | 825 | 1 | 0.0045 |
| 67 | 0.25 | ○ | — | — | — | ○ | — | — | 10 | 0.5 | 20 | 270 | 825 | 1 | 0.0045 |
| 68 | 0.30 | ○ | — | — | — | ○ | — | — | 10 | 0.5 | 20 | 270 | 850 | 1 | 0.0032 |
| 69 | 0.30 | ○ | — | — | — | ○ | — | — | 10 | 0.5 | 20 | 270 | 850 | 1 | 0.0032 |
| 70 | 0.30 | ○ | — | — | — | ○ | — | — | 10 | 0.5 | 20 | 270 | 850 | 1 | 0.0032 |
| 71 | 0.30 | ○ | — | — | — | ○ | — | — | 10 | 0.5 | 20 | 270 | 850 | 1 | 0.0032 |
| 72 | 0.30 | ○ | — | — | — | ○ | — | — | 10 | 0.5 | 20 | 270 | 850 | 1 | 0.0032 |
| 73 | 0.30 | ○ | — | — | — | ○ | — | — | 10 | 0.5 | 20 | 270 | 850 | 1 | 0.0032 |
| 74 | 0.30 | ○ | — | — | — | ○ | — | — | 10 | 0.5 | 20 | 270 | 850 | 1 | 0.0032 |

| | Iron loss $W_{10/800}$ (W/kg) | | Steel sheet properties | | |
|---|---|---|---|---|---|
| Steel sheet No | Iron loss ref. value 15 + 80*t | Actual value | Scratch resistance evaluation | Coating adhesiveness evaluation | Remarks |
| 1 | 35.0 | 28.3 | ○ | ○ | Inventive Example |
| 2 | 35.0 | 30.2 | ○ | ○ | Inventive Example |
| 3 | 39.0 | 33.0 | ○ | ○ | Inventive Example |
| 4 | 31.0 | 25.3 | ○ | ○ | Inventive Example |
| 5 | 27.0 | 22.9 | ○ | ○ | Inventive Example |
| 6 | 27.0 | 33.8 | ○ | ○ | Comparative Example |
| 7 | 35.0 | 40.1 | ○ | ○ | Comparative Example |
| 8 | 35.0 | 27.9 | ○ | ○ | Inventive Example |
| 9 | 35.0 | 30.4 | ○ | ○ | Inventive Example |
| 10 | 35.0 | 30.2 | ○ | ○ | Inventive Example |
| 11 | 31.0 | 24.9 | ○ | ○ | Inventive Example |

TABLE 2-continued

| | | | | | |
|---|---|---|---|---|---|
| 12 | 35.0 | 39.8 | ○ | ○ | Comparative Example |
| 13 | 35.0 | 27.8 | ○ | ○ | Inventive Example |
| 14 | 36.6 | 29.6 | ○ | ○ | Inventive Example |
| 15 | 35.0 | 27.4 | ○ | ○ | Inventive Example |
| 16 | — | — | — | — | Comparative Example |
| 17 | — | — | — | — | Comparative Example |
| 18 | 35.0 | 27.3 | ○ | ○ | Inventive Example |
| 19 | 35.0 | 26.3 | ○ | ○ | Inventive Example |
| 20 | — | — | — | — | Comparative Example |
| 21 | 39.0 | 32.5 | ○ | ○ | Inventive Example |
| 22 | 31.0 | 24.9 | ○ | ○ | Inventive Example |
| 23 | — | — | — | — | Comparative Example |
| 24 | 35.0 | 25.8 | ○ | ○ | Inventive Example |
| 25 | 35.0 | 28.3 | ○ | ○ | Inventive Example |
| 26 | 36.6 | 29.1 | ○ | ○ | Inventive Example |
| 27 | 35.0 | 43.5 | ○ | ○ | Comparative Example |
| 28 | 35.0 | 44.1 | ○ | ○ | Comparative Example |
| 29 | 35.0 | 44.3 | ○ | ○ | Comparative Example |
| 30 | 35.0 | 40.9 | ○ | ○ | Comparative Example |
| 31 | 35.0 | 44.6 | ○ | ○ | Comparative Example |
| 32 | 31.0 | 25.3 | ○ | ○ | Inventive Example |
| 33 | 35.0 | 27.2 | ○ | ○ | Inventive Example |
| 34 | 39.0 | 32.0 | ○ | ○ | Inventive Example |
| 35 | 27.0 | 22.5 | ○ | ○ | Inventive Example |
| 36 | 31.0 | 25.9 | ○ | ○ | Inventive Example |
| 37 | 35.0 | 27.7 | ○ | ○ | Inventive Example |
| 38 | 35.0 | 28.8 | ○ | ○ | Inventive Example |
| 39 | 35.0 | 27.8 | ○ | ○ | Inventive Example |
| 40 | 35.0 | 27.9 | ○ | ○ | Inventive Example |
| 41 | 35.0 | 27.9 | ○ | ○ | Inventive Example |
| 42 | 35.0 | 27.3 | ○ | ○ | Inventive Example |
| 43 | 35.0 | 27.4 | ○ | ○ | Inventive Example |
| 44 | 35.0 | 27.2 | ○ | ○ | Inventive Example |
| 45 | 35.0 | 27.1 | ○ | ○ | Inventive Example |
| 46 | 35.0 | 27.1 | ○ | ○ | Inventive Example |
| 47 | 35.0 | 27.1 | ○ | ○ | Inventive Example |
| 48 | 31.0 | 24.9 | ○ | ○ | Inventive Example |
| 49 | 31.0 | 24.8 | ○ | ○ | Inventive Example |
| 50 | 31.0 | 24.8 | ○ | ○ | Inventive Example |
| 51 | 31.0 | 24.7 | ○ | ○ | Inventive Example |
| 52 | 36.6 | 29.2 | ○ | ○ | Inventive Example |
| 53 | 36.6 | 29.1 | ○ | ○ | Inventive Example |
| 54 | 36.6 | 29.0 | ○ | ○ | Inventive Example |
| 55 | 36.6 | 29.1 | ○ | ○ | Inventive Example |
| 56 | 35.0 | 27.2 | ○ | ○ | Inventive Example |
| 57 | 35.0 | 27.2 | ○ | ○ | Inventive Example |
| 58 | 35.0 | 27.1 | ○ | ○ | Inventive Example |
| 59 | 35.0 | 27.1 | ○ | ○ | Inventive Example |
| 60 | 35.0 | 25.3 | ○ | ○ | Inventive Example |
| 61 | 35.0 | 25.3 | ○ | ○ | Inventive Example |
| 62 | 35.0 | 25.2 | ○ | ○ | Inventive Example |
| 63 | 35.0 | 25.3 | ○ | ○ | Inventive Example |
| 64 | 35.0 | 26.9 | ○ | ○ | Inventive Example |
| 65 | 35.0 | 27.0 | ○ | ○ | Inventive Example |
| 66 | 35.0 | 26.8 | ○ | ○ | Inventive Example |
| 67 | 35.0 | 26.9 | ○ | ○ | Inventive Example |
| 68 | 39.0 | 32.1 | ○ | ○ | Inventive Example |
| 69 | 39.0 | 32.2 | ○ | ○ | Inventive Example |
| 70 | 39.0 | 32.1 | ○ | ○ | Inventive Example |
| 71 | 39.0 | 32.2 | ○ | ○ | Inventive Example |
| 72 | 39.0 | 32.0 | ○ | ○ | Inventive Example |
| 73 | 39.0 | 31.9 | ○ | ○ | Inventive Example |
| 74 | 39.0 | 32.2 | ○ | ○ | Inventive Example |

*: Nos. 16, 17, and 20 cannot be produced due to slab cracking. No. 23 cannot be produced due to sheet breakage in cold rolling.

TABLE 3

| No. | Name | Classification | Product name |
|---|---|---|---|
| A | Monomagnesium phosphate: $Mg(H_2PO_4)_2$ | P-containing inorganic material | Monomagnesium phosphate made by Taihei Chemical Industrial Co., Ltd. |
| B | Antimony pentoxide sol: $Sb_2O_5$ | Sb-containing inorganic material | A-2550 made by Nissan Chemical Corporation |

TABLE 3-continued

| No. | Name | Classification | Product name |
|---|---|---|---|
| C | Tetrabutyltin: $(C_4H_9)_4Sn$ | Sn-containing inorganic material | T0058 made by Tokyo Chemical Industry Co., td.: ST-C (silica sol) made by Nissan Chemical Corporation = 1:15 (mixture) |

TABLE 3-continued

| No. | Name | Classification | Product name |
|---|---|---|---|
| D | Selenium Dioxide powder: $SeO_2$ | Se-containing inorganic material | 1980352 made by Fujifilm Wako Pure Chemical Corporation: ST-C(silica sol) made by Nissan Chemical Corporation = 1:30(mixture) |
| E | Aqueous acrylic resin | Organic resin | EFD-5560 made by DIC Corporation |
| F | Aqueous polyether resin | Organic resin | R-966 made by Kusumoto Chemicals Ltd. |
| G | Surface active agent | Another component | SURFYNOL400 made by Nissin Chemical Industry Ltd. |

The result is also shown in Table 2. The result shows that the steel sheets produced under conditions adapted to the present invention all have excellent iron loss properties, scratch resistance, and coating adhesiveness.

Example 2

Slabs having various component compositions shown in Table 4 and the remainder being Fe and inevitable impurities are heated to a temperature at 1120° C. for 30 minutes, hot-rolled to each form a hot-rolled sheet having a sheet thickness of 2.0 mm, subjected to hot-band annealing at 930° C. for 30 seconds, pickled for descaling and cold-rolled to form a cold-rolled sheet having the final sheet thickness shown in Table 5. Then, the cold-rolled sheet is subjected to finish annealing at 820° C. for 10 seconds under an atmosphere of $H_2$: $N_2$=20:80 by vol % ratio, coated with a treatment agent A or B shown in Table 6, and dried to form an intermediate layer having a coating thickness of 5 to 100 nm after the drying. A coating agent for the insulation coating prepared by combining the components C to G shown in Table 6 in configurations shown in Table 5 is applied on both sides of the steel sheet by a roll coater so that the coating weight per one side has the value shown in Table 5, and baked in a hot-air drying furnace under the conditions shown in Table 5 thus to produce a product sheet.

Test specimens with a length of 280 mm and a width of 30 mm are taken out from the rolling direction (L-direction) and the direction perpendicular to the rolling direction (C-direction) of the thus-obtained product sheet having the intermediate layer and the insulation coating, and subjected to stress-relief annealing under conditions shown in Table 5 in an atmosphere of $N_2$=100 vol % under the conditions shown in Table 5 to measure iron loss $W_{10/800}$ by the Epstein test. Also, the steel sheet after the stress-relief annealing is subjected to an electrolytic extraction method to analyze the concentration of N present as AlN (N as AlN) in the 1/20 sheet thickness layer.

Two pieces of test specimen with a width of 100 mm and a length of 200 mm are taken out from the rolling direction (L-direction) of the product sheet having the intermediate layer and insulation coating as the length direction under each condition. As in Example 1, the two test specimens are stacked on top of each other, slid at a relative speed of 2 cm/s for 10 seconds while applying a pressure of 1 kg/cm$^2$ thereto, and visually observed to determine the presence or absence of a scratch on the surface of the test specimens, from which the scratch resistance is evaluated according to the evaluation criteria below.

<Scratch Resistance Evaluation Criteria>

◎: Almost no scratch is observed (acceptable)

○: A few scratches are observed (acceptable)

x: A scratch is clearly observed (rejected)

Moreover, two pieces of test specimen with a width of 100 mm and a length of 200 mm are taken out from the rolling direction (L-direction) of each product sheet coated with the insulation coating as the length direction under each condition. An adhesive cellophane tape is attached to the surface to be tested, and the steel sheet is subjected to 180° bending using a round bar with a 5 mm-diameter with the surface to be tested as the compression side. Thereafter, the adhesive cellophane tape is taken off and the stripped area of the coating is calculated to evaluate the coating adhesiveness according to the criteria below.

<Coating Adhesiveness Evaluation Criteria>

◎: Stripped area of the coating <5% (acceptable)

○: 5%<stripped area of the coating <10% (acceptable)

x: Stripped area of the coating ≥10% (rejected)

TABLE 4

| Steel sheet | Component composition (mass %) | | | | | | | | | | | |
|---|---|---|---|---|---|---|---|---|---|---|---|---|
| No | C | Si | Mn | P | S | Al | Zn | Ti | Nb | O | N | Sn |
| 1 | 0.0025 | 3.6 | 0.4 | 0.01 | 0.0018 | 0.9 | 0.0021 | 0.0011 | 0.0009 | 0.0024 | 0.0022 | 0.03 |
| 2 | 0.0025 | 3.6 | 0.4 | 0.01 | 0.0018 | 0.9 | 0.0021 | 0.0011 | 0.0009 | 0.0024 | 0.0022 | 0.03 |
| 3 | 0.0025 | 3.6 | 0.4 | 0.01 | 0.0018 | 0.9 | 0.0021 | 0.0011 | 0.0009 | 0.0024 | 0.0022 | 0.03 |
| 4 | 0.0025 | 3.6 | 0.4 | 0.01 | 0.0018 | 0.9 | 0.0021 | 0.0011 | 0.0009 | 0.0024 | 0.0022 | 0.03 |
| 5 | 0.0025 | 3.6 | 0.4 | 0.01 | 0.0018 | 0.9 | 0.0003 | 0.0011 | 0.0009 | 0.0024 | 0.0022 | 0.03 |
| 6 | 0.0021 | 3.8 | 0.5 | 0.01 | 0.0019 | 0.6 | 0.0029 | 0.0013 | 0.0011 | 0.0025 | 0.0024 | — |
| 7 | 0.0021 | 3.8 | 0.5 | 0.01 | 0.0019 | 0.6 | 0.0029 | 0.0013 | 0.0011 | 0.0025 | 0.0024 | — |
| 8 | 0.0021 | 3.8 | 0.5 | 0.01 | 0.0019 | 0.6 | 0.0029 | 0.0013 | 0.0011 | 0.0025 | 0.0024 | — |
| 9 | 0.0021 | 3.8 | 0.5 | 0.01 | 0.0019 | 0.6 | 0.0029 | 0.0013 | 0.0011 | 0.0025 | 0.0024 | — |
| 10 | 0.0028 | 3.2 | 0.8 | 0.01 | 0.0024 | 1.2 | 0.0024 | 0.0008 | 0.0012 | 0.0021 | 0.0019 | 0.04 |
| 11 | 0.0028 | 3.2 | 0.8 | 0.01 | 0.0024 | 1.8 | 0.0024 | 0.0008 | 0.0012 | 0.0021 | 0.0020 | 0.04 |
| 12 | 0.0029 | 3.5 | 2.5 | 0.01 | 0.0024 | 0.5 | 0.0021 | 0.0008 | 0.0011 | 0.0021 | 0.0028 | — |
| 13 | 0.0025 | 3.3 | 0.1 | 0.01 | 0.0024 | 2.5 | 0.0015 | 0.0008 | 0.0011 | 0.0021 | 0.0021 | — |
| 14 | 0.0019 | 4.2 | 0.3 | 0.01 | 0.0015 | 0.3 | 0.0026 | 0.0014 | 0.0012 | 0.0019 | 0.0027 | — |
| 15 | 0.0019 | 5.6 | 0.3 | 0.01 | 0.0015 | 0.3 | 0.0027 | 0.0014 | 0.0012 | 0.0019 | 0.0027 | — |
| 16 | 0.0022 | 7.2 | 0.2 | 0.01 | 0.0024 | 0.3 | 0.0038 | 0.0008 | 0.0011 | 0.0021 | 0.0028 | — |
| 17 | 0.0021 | 4.0 | 0.4 | 0.01 | 0.0026 | 0.6 | 0.0032 | 0.0011 | 0.0013 | 0.0028 | 0.0024 | 0.03 |
| 18 | 0.0021 | 4.1 | 0.4 | 0.01 | 0.0026 | 0.6 | 0.0032 | 0.0011 | 0.0013 | 0.0028 | 0.0024 | 0.03 |
| 19 | 0.0026 | 3.2 | 0.1 | 0.25 | 0.0026 | 1.5 | 0.0025 | 0.0011 | 0.0013 | 0.0028 | 0.0024 | 0.06 |
| 20 | 0.0024 | 3.4 | 1.2 | 0.01 | 0.0019 | 0.9 | 0.0024 | 0.0016 | 0.0014 | 0.0027 | 0.0021 | 0.03 |
| 21 | 0.0024 | 3.3 | 1.8 | 0.01 | 0.0019 | 0.7 | 0.0024 | 0.0016 | 0.0014 | 0.0027 | 0.0021 | 0.03 |

TABLE 4-continued

| | | | | | | | | | | | | |
|---|---|---|---|---|---|---|---|---|---|---|---|---|
| 22 | 0.0018 | 3.5 | 0.2 | 0.01 | 0.0015 | 0.9 | 0.0021 | 0.0012 | 0.0009 | 0.0027 | 0.0021 | — |
| 23 | 0.0025 | 3.3 | 0.6 | 0.01 | 0.0059 | 0.9 | 0.0019 | 0.0018 | 0.0013 | 0.0029 | 0.0026 | 0.04 |
| 24 | 0.0025 | 3.8 | 0.2 | 0.01 | 0.0015 | 0.5 | 0.0021 | 0.0041 | 0.0013 | 0.0029 | 0.0026 | 0.04 |
| 25 | 0.0025 | 3.8 | 0.2 | 0.01 | 0.0015 | 0.5 | 0.0021 | 0.0007 | 0.0038 | 0.0029 | 0.0026 | 0.04 |
| 26 | 0.0025 | 3.8 | 0.2 | 0.01 | 0.0015 | 0.5 | 0.0021 | 0.0007 | 0.0011 | 0.0064 | 0.0026 | 0.04 |
| 27 | 0.0025 | 3.8 | 0.2 | 0.01 | 0.0015 | 0.5 | 0.0021 | 0.0007 | 0.0011 | 0.0021 | 0.0065 | 0.04 |
| 28 | 0.0021 | 4.1 | 0.5 | 0.01 | 0.0023 | 0.7 | 0.0024 | 0.0012 | 0.0013 | 0.0023 | 0.0022 | 0.03 |
| 29 | 0.0021 | 4.1 | 0.5 | 0.01 | 0.0023 | 0.7 | 0.0024 | 0.0012 | 0.0013 | 0.0023 | 0.0022 | 0.03 |
| 30 | 0.0021 | 4.1 | 0.5 | 0.01 | 0.0023 | 0.7 | 0.0024 | 0.0012 | 0.0013 | 0.0023 | 0.0022 | 0.03 |
| 31 | 0.0026 | 3.4 | 0.9 | 0.01 | 0.0026 | 1.4 | 0.0019 | 0.0018 | 0.0012 | 0.0021 | 0.0023 | 0.03 |
| 32 | 0.0026 | 3.4 | 0.9 | 0.01 | 0.0026 | 1.4 | 0.0019 | 0.0018 | 0.0012 | 0.0021 | 0.0023 | 0.03 |
| 33 | 0.0026 | 3.4 | 0.9 | 0.01 | 0.0026 | 1.4 | 0.0019 | 0.0018 | 0.0012 | 0.0021 | 0.0023 | 0.03 |
| 34 | 0.0025 | 3.7 | 0.8 | 0.01 | 0.0021 | 0.8 | 0.0021 | 0.0013 | 0.0013 | 0.0032 | 0.0031 | 0.03 |
| 35 | 0.0021 | 3.8 | 0.5 | 0.01 | 0.0019 | 0.6 | 0.0029 | 0.0013 | 0.0011 | 0.0025 | 0.0024 | — |
| 36 | 0.0021 | 3.8 | 0.5 | 0.01 | 0.0019 | 0.6 | 0.0029 | 0.0013 | 0.0011 | 0.0025 | 0.0024 | — |
| 37 | 0.0021 | 3.8 | 0.5 | 0.01 | 0.0019 | 0.6 | 0.0029 | 0.0013 | 0.0011 | 0.0025 | 0.0024 | — |
| 38 | 0.0021 | 3.8 | 0.5 | 0.01 | 0.0019 | 0.6 | 0.0029 | 0.0013 | 0.0011 | 0.0025 | 0.0024 | — |
| 39 | 0.0021 | 3.8 | 0.5 | 0.01 | 0.0019 | 0.6 | 0.0029 | 0.0013 | 0.0011 | 0.0025 | 0.0024 | — |
| 40 | 0.0021 | 3.8 | 0.5 | 0.01 | 0.0019 | 0.6 | 0.0029 | 0.0013 | 0.0011 | 0.0025 | 0.0024 | — |
| 41 | 0.0021 | 4.1 | 0.5 | 0.01 | 0.0023 | 0.7 | 0.0024 | 0.0012 | 0.0013 | 0.0023 | 0.0022 | 0.03 |
| 42 | 0.0021 | 4.1 | 0.5 | 0.01 | 0.0023 | 0.7 | 0.0024 | 0.0012 | 0.0013 | 0.0023 | 0.0022 | 0.03 |
| 43 | 0.0021 | 4.1 | 0.5 | 0.01 | 0.0023 | 0.7 | 0.0024 | 0.0012 | 0.0013 | 0.0023 | 0.0022 | 0.03 |
| 44 | 0.0021 | 4.1 | 0.5 | 0.01 | 0.0023 | 0.7 | 0.0024 | 0.0012 | 0.0013 | 0.0023 | 0.0022 | 0.03 |
| 45 | 0.0028 | 3.2 | 0.8 | 0.01 | 0.0024 | 1.2 | 0.0024 | 0.0008 | 0.0012 | 0.0021 | 0.0019 | 0.04 |
| 46 | 0.0028 | 3.2 | 0.8 | 0.01 | 0.0024 | 1.2 | 0.0024 | 0.0008 | 0.0012 | 0.0021 | 0.0019 | 0.04 |
| 47 | 0.0028 | 3.2 | 0.8 | 0.01 | 0.0024 | 1.2 | 0.0024 | 0.0008 | 0.0012 | 0.0021 | 0.0019 | 0.04 |
| 48 | 0.0028 | 3.2 | 0.8 | 0.01 | 0.0024 | 1.2 | 0.0024 | 0.0008 | 0.0012 | 0.0021 | 0.0019 | 0.04 |
| 49 | 0.0026 | 3.4 | 0.9 | 0.01 | 0.0026 | 1.4 | 0.0019 | 0.0018 | 0.0012 | 0.0021 | 0.0023 | 0.03 |
| 50 | 0.0026 | 3.4 | 0.9 | 0.01 | 0.0026 | 1.4 | 0.0019 | 0.0018 | 0.0012 | 0.0021 | 0.0023 | 0.03 |
| 51 | 0.0026 | 3.4 | 0.9 | 0.01 | 0.0026 | 1.4 | 0.0019 | 0.0018 | 0.0012 | 0.0021 | 0.0023 | 0.03 |
| 52 | 0.0026 | 3.4 | 0.9 | 0.01 | 0.0026 | 1.4 | 0.0019 | 0.0018 | 0.0012 | 0.0021 | 0.0023 | 0.03 |
| 53 | 0.0024 | 3.4 | 1.2 | 0.01 | 0.0019 | 0.9 | 0.0024 | 0.0016 | 0.0014 | 0.0027 | 0.0021 | 0.03 |
| 54 | 0.0024 | 3.4 | 1.2 | 0.01 | 0.0019 | 0.9 | 0.0024 | 0.0016 | 0.0014 | 0.0027 | 0.0021 | 0.03 |
| 55 | 0.0024 | 3.4 | 1.2 | 0.01 | 0.0019 | 0.9 | 0.0024 | 0.0016 | 0.0014 | 0.0027 | 0.0021 | 0.03 |
| 56 | 0.0024 | 3.4 | 1.2 | 0.01 | 0.0019 | 0.9 | 0.0024 | 0.0016 | 0.0014 | 0.0027 | 0.0021 | 0.03 |
| 57 | 0.0028 | 3.2 | 0.8 | 0.01 | 0.0024 | 1.8 | 0.0024 | 0.0008 | 0.0012 | 0.0021 | 0.0020 | 0.04 |
| 58 | 0.0028 | 3.2 | 0.8 | 0.01 | 0.0024 | 1.8 | 0.0024 | 0.0008 | 0.0012 | 0.0021 | 0.0020 | 0.04 |
| 59 | 0.0028 | 3.2 | 0.8 | 0.01 | 0.0024 | 1.8 | 0.0024 | 0.0008 | 0.0012 | 0.0021 | 0.0020 | 0.04 |
| 60 | 0.0028 | 3.2 | 0.8 | 0.01 | 0.0024 | 1.8 | 0.0024 | 0.0008 | 0.0012 | 0.0021 | 0.0020 | 0.04 |
| 61 | 0.0025 | 3.6 | 0.4 | 0.01 | 0.0018 | 0.9 | 0.0021 | 0.0011 | 0.0009 | 0.0024 | 0.0022 | 0.03 |
| 62 | 0.0025 | 3.6 | 0.4 | 0.01 | 0.0018 | 0.9 | 0.0021 | 0.0011 | 0.0009 | 0.0024 | 0.0022 | 0.03 |
| 63 | 0.0025 | 3.6 | 0.4 | 0.01 | 0.0018 | 0.9 | 0.0021 | 0.0011 | 0.0009 | 0.0024 | 0.0022 | 0.03 |
| 64 | 0.0025 | 3.6 | 0.4 | 0.01 | 0.0018 | 0.9 | 0.0021 | 0.0011 | 0.0009 | 0.0024 | 0.0022 | 0.03 |
| 65 | 0.0025 | 3.6 | 0.4 | 0.01 | 0.0018 | 0.9 | 0.0021 | 0.0011 | 0.0009 | 0.0024 | 0.0022 | 0.03 |
| 66 | 0.0025 | 3.6 | 0.4 | 0.01 | 0.0018 | 0.9 | 0.0021 | 0.0011 | 0.0009 | 0.0024 | 0.0022 | 0.03 |
| 67 | 0.0025 | 3.6 | 0.4 | 0.01 | 0.0018 | 0.9 | 0.0021 | 0.0011 | 0.0009 | 0.0024 | 0.0022 | — |

| Steel | Component composition (mass %) | | | | |
|---|---|---|---|---|---|
| sheet No | Sb | Ca, Mg, REM | Cu, Ni, Cr, Co | Mo, W | Remarks |
| 1 | — | — | — | — | Inventive steel |
| 2 | — | — | — | — | Inventive steel |
| 3 | — | — | — | — | Inventive steel |
| 4 | — | — | — | — | Inventive steel |
| 5 | — | — | — | — | Comparative steel |
| 6 | — | — | — | — | Inventive steel |
| 7 | — | — | — | — | Inventive steel |
| 8 | — | — | — | — | Inventive steel |
| 9 | — | — | — | — | Inventive steel |
| 10 | — | — | — | — | Inventive steel |
| 11 | — | — | — | — | Inventive steel |
| 12 | — | — | — | — | Comparative steel |
| 13 | — | — | — | — | Comparative steel |
| 14 | 0.01 | — | — | — | Inventive steel |
| 15 | — | — | — | — | Inventive steel |
| 16 | — | — | — | — | Comparative steel |
| 17 | — | — | — | — | Inventive steel |
| 18 | — | — | — | — | Inventive steel |
| 19 | — | — | — | — | Comparative steel |
| 20 | — | — | — | — | Inventive steel |
| 21 | — | — | — | — | Inventive steel |
| 22 | 0.05 | — | — | — | Inventive steel |
| 23 | — | — | — | — | Comparative steel |
| 24 | — | — | — | — | Comparative steel |
| 25 | — | — | — | — | Comparative steel |
| 26 | — | — | — | — | Comparative steel |
| 27 | — | — | — | — | Comparative steel |
| 28 | — | — | — | — | Inventive steel |

TABLE 4-continued

| | | | | | |
|---|---|---|---|---|---|
| 29 | — | — | — | — | Inventive steel |
| 30 | — | — | — | — | Inventive steel |
| 31 | — | — | — | — | Inventive steel |
| 32 | — | — | — | — | Inventive steel |
| 33 | — | — | — | — | Inventive steel |
| 34 | — | — | — | — | Inventive steel |
| 35 | — | Ca: 0.0032 | — | — | Inventive steel |
| 36 | — | Mg: 0.0023 | — | — | Inventive steel |
| 37 | — | REM: 0.0065 | — | — | Inventive steel |
| 38 | — | Ca: 0.0021, Mg: 0.0032 | — | — | Inventive steel |
| 39 | — | Ca: 0.0015, REM: 0.0025 | — | — | Inventive steel |
| 40 | — | Mg: 0.0015, REM: 0.0035 | — | — | Inventive steel |
| 41 | — | — | Cu: 0.05 | — | Inventive steel |
| 42 | — | — | Cu: 0.1 | — | Inventive steel |
| 43 | — | — | Cu: 0.5 | — | Inventive steel |
| 44 | — | — | Cu: 0.9 | — | Inventive steel |
| 45 | — | — | Cr: 0.05 | — | Inventive steel |
| 46 | — | — | Cr: 0.1 | — | Inventive steel |
| 47 | — | — | Cr: 0.5 | — | Inventive steel |
| 48 | — | — | Cr: 0.9 | — | Inventive steel |
| 49 | — | — | Ni: 0.05 | — | Inventive steel |
| 50 | — | — | Ni: 0.1 | — | Inventive steel |
| 51 | — | — | Ni: 0.5 | — | Inventive steel |
| 52 | — | — | Ni: 0.9 | — | Inventive steel |
| 53 | — | — | Co:0.05 | — | Inventive steel |
| 54 | — | — | Co: 0.1 | — | Inventive steel |
| 55 | — | — | Co: 0.5 | — | Inventive steel |
| 56 | — | — | Co: 0.9 | — | Inventive steel |
| 57 | — | — | Cu: 0.3, Ni: 0.3 | — | Inventive steel |
| 58 | — | — | Cr: 0.3, Co: 0.3 | — | Inventive steel |
| 59 | — | — | Ni: 0.3, Co: 0.3 | — | Inventive steel |
| 60 | — | — | Cu: 0.3, Co: 0.3 | — | Inventive steel |
| 61 | — | — | — | Mo: 0.0025 | Inventive steel |
| 62 | — | — | — | Mo: 0.05 | Inventive steel |
| 63 | — | — | — | W: 0.0025 | Inventive steel |
| 64 | — | — | — | W: 0.06 | Inventive steel |
| 65 | — | — | — | Mo: 0.0025, W: 0.0025 | Inventive steel |
| 66 | — | Ca: 0.0024 | — | Mo: 0.0025 | Inventive steel |
| 67 | — | Ca: 0.0024 | — | Mo: 0.0025 | Inventive steel |

TABLE 5

| Steel sheet No | Final sheet thickness t (mm) | Intermediate layer A | Intermediate layer B | Insulation coating: Inorganic C | Inorganic D | Organic E | Organic F | Others G | Solid content concentration (mass %) | Coating weight (g/m$^2$) | Baking time (s) | Baking temp. (° C.) | Stress-relief annealing conditions: Temp. (° C.) | Stress-relief annealing conditions: Time (hr) | N as AIN (mass %) in 1/20 sheet thickness layer after stress-relief annealing |
|---|---|---|---|---|---|---|---|---|---|---|---|---|---|---|---|
| 1 | 0.25 | ○ | — | ○ | — | ○ | — | — | 10 | 0.5 | 20 | 270 | 850 | 1 | 0.0035 |
| 2 | 0.30 | ○ | — | ○ | — | ○ | — | — | 10 | 0.5 | 20 | 270 | 850 | 1 | 0.0032 |
| 3 | 0.20 | ○ | — | ○ | — | ○ | — | ○ | 10 | 0.5 | 20 | 270 | 850 | 1 | 0.0034 |
| 4 | 0.15 | ○ | — | ○ | — | ○ | — | ○ | 10 | 0.5 | 20 | 270 | 850 | 1 | 0.0037 |
| 5 | 0.25 | ○ | — | ○ | — | ○ | — | ○ | 10 | 0.5 | 20 | 270 | 850 | 1 | 0.0140 |
| 6 | 0.25 | ○ | — | ○ | — | ○ | — | — | 10 | 0.5 | 20 | 270 | 825 | 1 | 0.0024 |
| 7 | 0.20 | ○ | — | ○ | — | ○ | — | — | 10 | 0.5 | 20 | 270 | 825 | 1 | 0.0024 |
| 8 | 0.25 | ○ | — | ○ | — | ○ | — | — | 10 | 0.5 | 20 | 270 | 700 | 1 | 0.0039 |
| 9 | 0.25 | — | ○ | ○ | — | ○ | — | — | 10 | 0.5 | 20 | 270 | 800 | 2 | 0.0041 |
| 10 | 0.27 | — | ○ | ○ | — | ○ | — | — | 10 | 0.5 | 20 | 270 | 825 | 1 | 0.0049 |
| 11 | 0.25 | — | ○ | ○ | — | ○ | — | — | 10 | 0.5 | 20 | 270 | 825 | 1 | 0.0045 |
| 12 | — | — | ○ | ○ | — | ○ | — | ○ | 10 | 0.5 | 20 | 270 | — | — | — |
| 13 | — | — | ○ | ○ | — | ○ | — | ○ | 10 | 0.5 | 20 | 270 | — | — | — |
| 14 | 0.25 | — | ○ | ○ | — | ○ | — | — | 10 | 0.5 | 20 | 270 | 900 | 1 | 0.0065 |
| 15 | 0.25 | — | ○ | ○ | — | ○ | — | — | 10 | 0.5 | 20 | 270 | 900 | 1 | 0.0064 |
| 16 | — | — | ○ | ○ | — | ○ | — | — | 10 | 0.5 | 20 | 270 | — | — | — |

TABLE 5-continued

| | | | | | | | | | | | | | | | |
|---|---|---|---|---|---|---|---|---|---|---|---|---|---|---|---|
| 17 | 0.30 | ○ | — | ○ | — | — | ○ | — | 10 | 0.5 | 20 | 270 | 825 | 1 | 0.0039 |
| 18 | 0.20 | ○ | — | ○ | — | — | ○ | — | 10 | 0.5 | 20 | 270 | 825 | 1 | 0.0038 |
| 19 | — | ○ | — | ○ | — | — | ○ | — | 10 | 0.5 | 20 | 270 | — | — | — |
| 20 | 0.25 | ○ | — | ○ | — | — | ○ | — | 10 | 0.5 | 20 | 270 | 850 | 1 | 0.0039 |
| 21 | 0.25 | ○ | — | ○ | — | — | ○ | ○ | 10 | 0.5 | 20 | 270 | 850 | 1 | 0.0045 |
| 22 | 0.27 | — | ○ | ○ | — | — | ○ | — | 10 | 0.5 | 20 | 270 | 825 | 1 | 0.0029 |
| 23 | 0.25 | — | ○ | ○ | ○ | ○ | — | — | 10 | 0.5 | 20 | 270 | 800 | 1 | 0.0045 |
| 24 | 0.25 | — | ○ | ○ | ○ | ○ | — | — | 10 | 0.5 | 20 | 270 | 800 | 1 | 0.0041 |
| 25 | 0.25 | ○ | — | ○ | ○ | ○ | — | — | 10 | 0.5 | 20 | 270 | 800 | 1 | 0.0043 |
| 26 | 0.25 | ○ | — | ○ | ○ | ○ | — | ○ | 10 | 0.5 | 20 | 270 | 800 | 1 | 0.0044 |
| 27 | 0.25 | ○ | — | ○ | ○ | ○ | — | — | 10 | 0.5 | 20 | 270 | 800 | 1 | 0.0081 |
| 28 | 0.20 | — | ○ | ○ | ○ | — | ○ | ○ | 10 | 0.5 | 20 | 270 | 830 | 1 | 0.0051 |
| 29 | 0.25 | — | ○ | — | ○ | — | ○ | ○ | 10 | 0.5 | 20 | 270 | 830 | 1 | 0.0053 |
| 30 | 0.30 | — | ○ | — | ○ | — | ○ | ○ | 10 | 0.5 | 20 | 270 | 830 | 1 | 0.0059 |
| 31 | 0.15 | ○ | — | — | ○ | — | ○ | — | 10 | 0.5 | 20 | 270 | 830 | 1 | 0.0054 |
| 32 | 0.20 | — | ○ | — | ○ | ○ | — | — | 10 | 0.5 | 20 | 270 | 900 | 0.5 | 0.0051 |
| 33 | 0.25 | — | ○ | — | ○ | ○ | — | — | 10 | 0.5 | 20 | 270 | 850 | 1 | 0.0053 |
| 34 | 0.25 | — | ○ | — | ○ | — | ○ | — | 10 | 0.5 | 20 | 270 | 850 | 2 | 0.0052 |
| 35 | 0.25 | ○ | — | ○ | — | ○ | — | — | 10 | 0.5 | 20 | 270 | 825 | 1 | 0.0024 |
| 36 | 0.25 | ○ | — | ○ | — | ○ | — | — | 10 | 0.5 | 20 | 270 | 825 | 1 | 0.0024 |
| 37 | 0.25 | ○ | — | ○ | — | ○ | — | — | 10 | 0.5 | 20 | 270 | 825 | 1 | 0.0024 |
| 38 | 0.25 | ○ | — | ○ | — | ○ | — | — | 10 | 0.5 | 20 | 270 | 825 | 1 | 0.0024 |
| 39 | 0.25 | ○ | — | ○ | — | ○ | — | — | 10 | 0.5 | 20 | 270 | 825 | 1 | 0.0024 |
| 40 | 0.25 | ○ | — | ○ | — | ○ | — | — | 10 | 0.5 | 20 | 270 | 825 | 1 | 0.0024 |
| 41 | 0.20 | — | ○ | ○ | ○ | — | ○ | ○ | 10 | 0.5 | 20 | 270 | 830 | 1 | 0.0051 |
| 42 | 0.20 | — | ○ | ○ | ○ | — | ○ | ○ | 10 | 0.5 | 20 | 270 | 830 | 1 | 0.0051 |
| 43 | 0.20 | — | ○ | ○ | ○ | — | ○ | ○ | 10 | 0.5 | 20 | 270 | 830 | 1 | 0.0051 |
| 44 | 0.20 | — | ○ | ○ | ○ | — | ○ | ○ | 10 | 0.5 | 20 | 270 | 830 | 1 | 0.0051 |
| 45 | 0.27 | — | ○ | ○ | — | ○ | — | — | 10 | 0.5 | 20 | 270 | 825 | 1 | 0.0049 |
| 46 | 0.27 | — | ○ | ○ | — | ○ | — | — | 10 | 0.5 | 20 | 270 | 825 | 1 | 0.0049 |
| 47 | 0.27 | — | ○ | ○ | — | ○ | — | — | 10 | 0.5 | 20 | 270 | 825 | 1 | 0.0049 |
| 48 | 0.27 | — | ○ | ○ | — | ○ | — | — | 10 | 0.5 | 20 | 270 | 825 | 1 | 0.0049 |
| 49 | 0.15 | ○ | — | — | ○ | — | ○ | — | 10 | 0.5 | 20 | 270 | 830 | 1 | 0.0054 |
| 50 | 0.15 | ○ | — | — | ○ | — | ○ | — | 10 | 0.5 | 20 | 270 | 830 | 1 | 0.0054 |
| 51 | 0.15 | ○ | — | — | ○ | — | ○ | — | 10 | 0.5 | 20 | 270 | 830 | 1 | 0.0054 |
| 52 | 0.15 | ○ | — | — | ○ | — | ○ | — | 10 | 0.5 | 20 | 270 | 830 | 1 | 0.0054 |
| 53 | 0.25 | ○ | — | ○ | — | — | ○ | — | 10 | 0.5 | 20 | 270 | 850 | 1 | 0.0039 |
| 54 | 0.25 | ○ | — | ○ | — | — | ○ | — | 10 | 0.5 | 20 | 270 | 850 | 1 | 0.0039 |
| 55 | 0.25 | ○ | — | ○ | — | — | ○ | — | 10 | 0.5 | 20 | 270 | 850 | 1 | 0.0039 |
| 56 | 0.25 | ○ | — | ○ | — | — | ○ | — | 10 | 0.5 | 20 | 270 | 850 | 1 | 0.0039 |
| 57 | 0.27 | — | ○ | ○ | — | ○ | — | — | 10 | 0.5 | 20 | 270 | 825 | 1 | 0.0049 |
| 58 | 0.27 | — | ○ | ○ | — | ○ | — | — | 10 | 0.5 | 20 | 270 | 825 | 1 | 0.0049 |
| 59 | 0.27 | — | ○ | ○ | — | ○ | — | — | 10 | 0.5 | 20 | 270 | 825 | 1 | 0.0049 |
| 60 | 0.27 | — | ○ | ○ | — | ○ | — | — | 10 | 0.5 | 20 | 270 | 825 | 1 | 0.0049 |
| 61 | 0.30 | ○ | — | ○ | — | ○ | — | — | 10 | 0.5 | 20 | 270 | 850 | 1 | 0.0032 |
| 62 | 0.30 | ○ | — | ○ | — | ○ | — | — | 10 | 0.5 | 20 | 270 | 850 | 1 | 0.0032 |
| 63 | 0.30 | ○ | — | ○ | — | ○ | — | — | 10 | 0.5 | 20 | 270 | 850 | 1 | 0.0032 |
| 64 | 0.30 | ○ | — | ○ | — | ○ | — | — | 10 | 0.5 | 20 | 270 | 850 | 1 | 0.0032 |
| 65 | 0.30 | ○ | — | ○ | — | ○ | — | — | 10 | 0.5 | 20 | 270 | 850 | 1 | 0.0032 |
| 66 | 0.30 | ○ | — | ○ | — | ○ | — | — | 10 | 0.5 | 20 | 270 | 850 | 1 | 0.0032 |
| 67 | 0.30 | ○ | — | ○ | — | ○ | — | — | 10 | 0.5 | 20 | 270 | 850 | 1 | 0.0032 |

| | Iron loss $W_{10/800}$ (W/kg) | | Steel sheet properties | | |
|---|---|---|---|---|---|
| Steel sheet No | Iron loss ref. value 15 + 80*t | Actual value | Scratch resistance evaluation | Coating adhesiveness evaluation | Remarks |
| 1 | 35.0 | 28.1 | ◎ | ◎ | Inventive Example |
| 2 | 40.0 | 33.1 | ◎ | ◎ | Inventive Example |
| 3 | 30.0 | 25.1 | ◎ | ◎ | Inventive Example |
| 4 | 25.0 | 22.8 | ◎ | ◎ | Inventive Example |
| 5 | 35.0 | 40.1 | ◎ | ◎ | Comparative Example |
| 6 | 35.0 | 27.8 | ◎ | ◎ | Inventive Example |
| 7 | 30.0 | 23.9 | ◎ | ◎ | Inventive Example |
| 8 | 35.0 | 39.8 | ◎ | ◎ | Comparative Example |
| 9 | 35.0 | 27.9 | ○ | ○ | Inventive Example |
| 10 | 37.0 | 29.7 | ○ | ○ | Inventive Example |
| 11 | 35.0 | 27.5 | ○ | ○ | Inventive Example |
| 12 | — | — | ○ | ○ | Comparative Example |
| 13 | — | — | ○ | ○ | Comparative Example |
| 14 | 35.0 | 27.1 | ○ | ○ | Inventive Example |
| 15 | 35.0 | 26.2 | ○ | ○ | Inventive Example |
| 16 | — | — | ○ | ○ | Comparative Example |
| 17 | 40.0 | 32.5 | ◎ | ◎ | Inventive Example |
| 18 | 30.0 | 24.8 | ◎ | ◎ | Inventive Example |
| 19 | — | — | ◎ | ◎ | Comparative Example |
| 20 | 35.0 | 28.4 | ◎ | ◎ | Inventive Example |
| 21 | 35.0 | 28.1 | ◎ | ◎ | Inventive Example |

TABLE 5-continued

| | | | | | |
|---|---|---|---|---|---|
| 22 | 37.0 | 28.9 | ○ | ○ | Inventive Example |
| 23 | 35.0 | 43.5 | ○ | ○ | Comparative Example |
| 24 | 35.0 | 44.1 | ○ | ○ | Comparative Example |
| 25 | 35.0 | 44.3 | ◎ | ◎ | Comparative Example |
| 26 | 35.0 | 40.9 | ◎ | ◎ | Comparative Example |
| 27 | 35.0 | 44.6 | ◎ | ◎ | Comparative Example |
| 28 | 30.0 | 25.1 | ○ | ○ | Inventive Example |
| 29 | 35.0 | 27.4 | ○ | ○ | Inventive Example |
| 30 | 40.0 | 32.1 | ○ | ○ | Inventive Example |
| 31 | 25.0 | 22.3 | ◎ | ◎ | Inventive Example |
| 32 | 30.0 | 25.8 | ○ | ○ | Inventive Example |
| 33 | 35.0 | 27.6 | ○ | ○ | Inventive Example |
| 34 | 35.0 | 27.5 | ○ | ○ | Inventive Example |
| 35 | 35.0 | 27.1 | ◎ | ◎ | Inventive Example |
| 36 | 35.0 | 27.2 | ◎ | ◎ | Inventive Example |
| 37 | 35.0 | 27.1 | ◎ | ◎ | Inventive Example |
| 38 | 35.0 | 27.0 | ◎ | ◎ | Inventive Example |
| 39 | 35.0 | 27.0 | ◎ | ◎ | Inventive Example |
| 40 | 35.0 | 27.0 | ◎ | ◎ | Inventive Example |
| 41 | 30.0 | 24.4 | ○ | ○ | Inventive Example |
| 42 | 30.0 | 24.3 | ○ | ○ | Inventive Example |
| 43 | 30.0 | 24.3 | ○ | ○ | Inventive Example |
| 44 | 30.0 | 24.3 | ○ | ○ | Inventive Example |
| 45 | 37.0 | 29.3 | ○ | ○ | Inventive Example |
| 46 | 37.0 | 29.2 | ○ | ○ | Inventive Example |
| 47 | 37.0 | 29.2 | ○ | ○ | Inventive Example |
| 48 | 37.0 | 29.3 | ○ | ○ | Inventive Example |
| 49 | 25.0 | 21.8 | ◎ | ◎ | Inventive Example |
| 50 | 25.0 | 21.7 | ◎ | ◎ | Inventive Example |
| 51 | 25.0 | 21.7 | ◎ | ◎ | Inventive Example |
| 52 | 25.0 | 21.6 | ◎ | ◎ | Inventive Example |
| 53 | 35.0 | 27.8 | ◎ | ◎ | Inventive Example |
| 54 | 35.0 | 27.7 | ◎ | ◎ | Inventive Example |
| 55 | 35.0 | 27.7 | ◎ | ◎ | Inventive Example |
| 56 | 35.0 | 27.7 | ◎ | ◎ | Inventive Example |
| 57 | 37.0 | 29.2 | ○ | ○ | Inventive Example |
| 58 | 37.0 | 29.1 | ○ | ○ | Inventive Example |
| 59 | 37.0 | 29.1 | ○ | ○ | Inventive Example |
| 60 | 37.0 | 29.2 | ○ | ○ | Inventive Example |
| 61 | 40.0 | 32.6 | ◎ | ◎ | Inventive Example |
| 62 | 40.0 | 32.5 | ◎ | ◎ | Inventive Example |
| 63 | 40.0 | 32.6 | ◎ | ◎ | Inventive Example |
| 64 | 40.0 | 32.5 | ◎ | ◎ | Inventive Example |
| 65 | 40.0 | 32.3 | ◎ | ◎ | Inventive Example |
| 66 | 40.0 | 32.3 | ◎ | ◎ | Inventive Example |
| 67 | 40.0 | 32.2 | ◎ | ◎ | Inventive Example |

*: Nos. 12, 13, and 17 cannot be produced due to slab cracking. No. 19 cannot be produced due to sheet breakage in cold rolling.

TABLE 6

| No. | Name | Classification | Product name |
|---|---|---|---|
| A | Manganese phosphate: $Mn_5(PO_3(OH))_2(PO_4)_2 \cdot 4H_2O$ | P-containing pretreatment agent (chemical conversion treatment) | PB-L47 made by Nihon Parkerizing Co., Ltd. |
| B | Metal Sn | Sn-containing pretreatment agent(high-frequency sputtering method) | Sputtering Target made by Advantec Co., Ltd. |
| C | Silica sol | Inorganic material | ST-C by Nissan Chemical Corporation. |
| D | Alumina sol | Inorganic material | AS-200 made by Nissan Chemical Corporation |
| E | Aqueous acrylic resin | Organic resin | EFD-5560 by DIC Corporation |
| F | Aqueous polyether resin | Organic resin | R-966 made by Kusumoto Chemicals Ltd. |

TABLE 6-continued

| No. | Name | Classification | Product name |
|---|---|---|---|
| G | Surface active agent | Other component | SURFYNOL400 made by Nissin Chemical Industry Ltd. |

The result is also shown in Table 5. The result shows that the steel sheets produced under conditions adapted to the present invention all have excellent iron loss properties. Further, compared to Table 2, scratch resistance, and coating adhesiveness is further improved by providing the intermediate layer having nitriding-suppressing effect between the insulation coating and the iron matrix surface of the steel sheet.

The invention of the present invention possesses an effect for increasing the strength of the insulation coating and can be applied not only to the field of non-oriented electrical steel sheets but also grain-oriented electrical steel sheets.

The invention claimed is:

1. A non-oriented electrical steel sheet having a component composition comprising: C: not more than 0.0050 mass %, Si: 2.8 to 6.5 mass %, Mn: 0.1 to 2.0 mass %, P: not more than 0.10 mass %, S: not more than 0.0050 mass %, Al: 0.3 to 2.0 mass %, N: not more than 0.0050 mass %, Zn: 0.0005 to 0.0050 mass %, Ti: not more than 0.0030 mass %, Nb: 0.0008 to 0.0030 mass %, O: not more than 0.0050 mass %, and the remainder being Fe and inevitable impurities, and having a coating layer containing at least one element selected from Sn, Sb, P, S, Se, As, Te, B, Pb, and Bi on a surface of an iron matrix of the steel sheet, wherein the coating layer comprises an insulation coating and an intermediate layer formed between the insulation coating and the surface of the iron matrix of the steel sheet, the intermediate layer contains at least one element selected from Sn, Sb, P, S, Se, As, Te, B, Pb, and Bi, and the insulation coating does not contain any element selected from Sn, Sb, P, S, Se, As, Te, B, Pb, and Bi.

2. The non-oriented electrical steel sheet according to claim 1, wherein the non-oriented electrical steel sheet contains, in addition to the above-described component composition, at least one composition group selected from the following Groups A to D:

Group A: one or two selected from Sn: 0.005 to 0.20 mass % and Sb: 0.005 to 0.20 mass %;

Group B: one or two or more selected from Ca, Mg and REM by 0.0005 to 0.020 mass % in total;

Group C: one or two or more selected from Cu, Ni, Cr, and Co by 0.01 to 1.0 mass % in total; and Group D: one or two selected from Mo: 0.001 to 0.1 mass % and W: 0.001 to 0.1 mass %.

3. A method for producing the non-oriented electrical steel sheet according to claim 1, the method comprising subjecting a steel slab to hot rolling, cold rolling, and finish annealing, wherein the steel slab has a component composition comprising C: not more than 0.0050 mass %, Si: 2.8 to 6.5 mass %, Mn: 0.1 to 2.0 mass %, P: not more than 0.10 mass %, S: not more than 0.0050 mass %, Al: 0.3 to 2.0 mass %, N: not more than 0.0050 mass %, Zn: 0.0005 to 0.0050 mass %, Ti: not more than 0.0030 mass %, Nb: 0.0008 to 0.0030 mass %, O: not more than 0.0050 mass %, and the remainder being Fe and inevitable impurities, and a coating layer containing at least one element selected from Sn, Sb, P, S, Se, As, Te, B, Pb, and Bi is formed on a surface of an iron matrix of the steel sheet after the finish annealing, wherein the coating layer comprises an insulation coating and an intermediate layer formed between the insulation coating and the surface of the iron matrix of the steel sheet, the intermediate layer contains at least one element selected from Sn, Sb, P, S, Se, As, Te, B, Pb, and Bi, and the insulation coating does not contain any element selected from Sn, Sb, P, S, Se, As, Te, B, Pb, and Bi.

4. The method for producing a non-oriented electrical steel sheet according to claim 3, wherein the steel slab contains at least one composition group selected from following Groups A to D:

Group A: one or two selected from Sn: 0.005 to 0.20 mass % and Sb: 0.005 to 0.20 mass %;

Group B: one or two or more selected from Ca, Mg and REM by 0.0005 to 0.020 mass % in total;

Group C: one or two or more selected from Cu, Ni, Cr, and Co by 0.01 to 1.0 mass % in total; and Group D: one or two selected from Mo: 0.001 to 0.1 mass % and W: 0.001 to 0.1 mass %.

5. The method for producing a non-oriented electrical steel sheet according to claim 3, wherein a treatment agent containing at least one element selected from Sn, Sb, P, S, Se, As, Te, B, Pb, and Bi is applied to the surface of the iron matrix of the steel sheet after the finish annealing to form, as the coating layer, the intermediate layer with a nitriding-suppressing ability and the insulation coating not containing the above-described elements is formed on the intermediate layer.

* * * * *